US012782041B2

(12) United States Patent
Seo et al.

(10) Patent No.: US 12,782,041 B2
(45) Date of Patent: Nov. 3, 2026

(54) REFRIGERATOR AND METHOD OF CONTROLLING REFRIGERATOR THAT CHANGES REFRIGERATING TEMPERATURE OF REFRIGERATING COMPARTMENT TO FREEZING TEMPERATURE

(71) Applicant: SAMSUNG ELECTRONICS CO., LTD., Suwon-si Gyeonggi-do (KR)

(72) Inventors: Junghoon Seo, Suwon-si (KR); Kyungtae Ko, Suwon-si (KR); Ganghyun Kim, Suwon-si (KR); Jaeuk Ryoo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 327 days.

(21) Appl. No.: 18/538,447

(22) Filed: Dec. 13, 2023

(65) Prior Publication Data

US 2024/0118021 A1 Apr. 11, 2024

Related U.S. Application Data

(63) Continuation of application No. PCT/KR2022/009172, filed on Jun. 28, 2022.

(30) Foreign Application Priority Data

Aug. 3, 2021 (KR) ..... 10-2021-0102173

(51) Int. Cl.
*F25D 29/00* (2006.01)

(52) U.S. Cl.
CPC ..... *F25D 29/005* (2013.01); *F25D 2600/02* (2013.01)

(58) Field of Classification Search
CPC ..... F25D 29/005; F25D 2600/02
(Continued)

(56) References Cited

U.S. PATENT DOCUMENTS 8,011,195 B2 9/2011 Park et al.
11,519,660 B2 12/2022 Jeong et al.
(Continued)

FOREIGN PATENT DOCUMENTS

CN 111351297 A 6/2020
JP 2011-99579 5/2011
(Continued)

OTHER PUBLICATIONS

International Search Report dated Oct. 12, 2022 issued in PCT Application No. PCT/KR2022/009172.
(Continued)

*Primary Examiner* — Jigneshkumar C Patel
(74) *Attorney, Agent, or Firm* — STAAS & HALSEY LLP

(57) ABSTRACT

A refrigerator is disclosed. The refrigerator includes a temperature sensor, a cooling device, and a processor which controls the cooling device such that, when a user command to change the temperature of a storage compartment set to a first temperature to a second temperatures, is input, the temperature of the storage compartment is changed to the second temperature, based on the temperature of the storage compartment sensed by the temperature sensor, and controls the cooling device such that, when a certain period of time elapses after a point in time when the user command is input, the temperature of the storage compartment returns to the first temperature, based on the temperature of the storage compartment sensed by the temperature sensor.

17 Claims, 26 Drawing Sheets

(58) Field of Classification Search
USPC ..... 700/300
See application file for complete search history.

(56) References Cited

U.S. PATENT DOCUMENTS

| | | | | |
|---|---|---|---|---|
| 2008/0066485 | A1* | 3/2008 | Park | A23B 7/04 62/441 |
| 2019/0128598 | A1* | 5/2019 | Song | F25D 17/045 |
| 2019/0264975 | A1* | 8/2019 | Kim | F25D 23/02 |
| 2019/0277559 | A1* | 9/2019 | Wang | F25D 17/065 |
| 2022/0235977 | A1* | 7/2022 | Yun | F25B 21/04 |

FOREIGN PATENT DOCUMENTS

| | | |
|---|---|---|
| KR | 10-0182584 | 5/1999 |
| KR | 10-0213904 | 8/1999 |
| KR | 10-0710239 | 4/2007 |
| KR | 10-2008-0025569 | 3/2008 |
| KR | 10-2015-0058744 | 5/2015 |
| KR | 10-2016-0048544 | 5/2016 |
| KR | 10-1803627 | 11/2017 |
| KR | 10-2019-0030092 | 3/2019 |
| KR | 10-2019-0089601 | 7/2019 |
| KR | 10-2020-0112433 | 10/2020 |
| KR | 10-2021-0053097 | 5/2021 |

OTHER PUBLICATIONS

Written Opinion dated Oct. 12, 2022 issued in PCT Application No. PCT/KR2022/009172.
Office Action dated Jul. 20, 2026, in Korean Patent Application No. 10-2021-0102173.

* cited by examiner

100

REFRIGERATOR AND METHOD OF CONTROLLING REFRIGERATOR THAT CHANGES REFRIGERATING TEMPERATURE OF REFRIGERATING COMPARTMENT TO FREEZING TEMPERATURE

CROSS-REFERENCE TO RELATED APPLICATIONS

This is a continuation application of International Application PCT/KR2022/009172, filed Jun. 28, 2022, which is incorporated herein by reference in its entirety, it being further noted that foreign priority benefit is based upon Korean Patent Application No. 10-2021-0102173, filed Aug. 3, 2021, the disclosures of which are incorporated by reference herein in their entirety.

TECHNICAL FIELD

The disclosure relates to a refrigerator and a method of controlling a refrigerator and, more specifically, to a refrigerator that temporarily changes a temperature of a storage compartment and a method of controlling the refrigerator.

BACKGROUND ART

Recently, as a single-person household is increasing and the time for people to live at home is increasing, the consumption of a frozen food easy to cook is increasing. Accordingly, the importance of a freezing compartment capacity for storing frozen food in the refrigerator is increasing.

In the meantime, it is general that a refrigerator includes a refrigerating compartment for refrigerating storage and a freezing compartment for freezing storage, a capacity of a freezing compartment that may be secured in a limited space inside a refrigerator is restricted.

Accordingly, a user of a refrigerator requires a function of a freezing compartment that may change the temperature of a refrigerating compartment to the temperature of a freezing compartment in order to store frozen food even in a refrigerating compartment.

In this case, in that all of the frozen foods stored in the refrigerating compartment may be consumed or may be continuously stored in the refrigerating compartment, it is an important issue that the time period in which the temperature of the refrigerating compartment is changed to the freezing compartment should be flexibly changed.

Technical Problem

The disclosure is to address the above-mentioned problems, and to provide a refrigerator that changes the temperature of a storage compartment to another temperature for a certain period of time and a method of controlling the refrigerator.

Technical Solution

According to an embodiment of the disclosure, a refrigerator may include a storage compartment, a temperature sensor, a cooling device, and a processor configured to, based on a user command to change a temperature of the storage compartment set to a first temperature, to a second temperature, being input, control the cooling device such that the temperature of the storage compartment is changed to the second temperature based on the temperature of the storage compartment sensed by the temperature sensor, and based on a certain period of time elapsing after a point in time when the user command is input, control the cooling device such that the temperature of the storage compartment returns to the first temperature based on the temperature of the storage compartment sensed by the temperature sensor.

In addition, the processor may be configured to, before the certain period of time elapses, provide a notification that indicates that the temperature of the storage compartment is to return to the first temperature at a predetermined time interval.

In this case, the refrigerator may further include a display, and the processor is configured to control the display to display the notification.

In addition, the refrigerator may further include a communication interface, and the processor may be configured to transmit, through the communication interface, the notification to a server that communicates with an electronic apparatus so that the notification is displayed on the electronic apparatus.

In the meantime, the processor may be configured to identify a weight of an object for storage in the storage compartment at a predetermined time interval after the user command is input, and based on the identified weight of the object for storage being less than or equal to a preset weight, provide a notification to request input of a user command to return the temperature of the storage compartment to the first temperature.

Here, the refrigerator may further include a communication interface, and the processor may be configured to transmit, through the communication interface, the notification to a server that communicates with an electronic apparatus so that the notification is displayed on the electronic apparatus.

In the meantime, the processor may be configured to, based on a user command to return the temperature of the storage compartment to the first temperature being input before the certain period of time elapses, control the cooling device such that the temperature of the storage compartment returns to the first temperature based on the temperature of the storage compartment sensed by the temperature sensor.

In addition, the processor may be configured to, based on a user command to extend the certain period of time being input before the certain period of time elapses, control the cooling device such that the temperature of the storage compartment returns to the first temperature based on the temperature of the storage compartment sensed by the temperature sensor.

In the meantime, the processor may be configured to identify whether to extend the certain period of time based on a weight of the object for storage in the storage compartment and based on identifying that the certain period of time is to be extended, if the extended certain period of time elapses, control the cooling device such that internal temperature of the storage compartment returns to the first temperature based on the internal temperature of the storage compartment sensed by the temperature sensor.

In this case, the processor may be configured to, based on identifying that the weight of the object for storage in the storage compartment increases or is not changed, identify that the certain period of time is to be extended.

In the meantime, a method of controlling a refrigerator according to an embodiment of the disclosure may include, based on a user command to change a temperature of a storage compartment of the refrigerator set to a first temperature, to a second temperature, being input, changing the temperature of the storage compartment to the second temperature based on the temperature of the storage compartment sensed by a temperature sensor, based on a certain period of time elapsing after a point in time when the user command is input, returning the temperature of the storage compartment to the first temperature based on the temperature of the storage compartment sensed by the temperature sensor.

The method may further include, before the certain period of time elapses, providing a notification that indicates that the temperature of the storage compartment is to return to the first temperature at a predetermined time interval.

In this case, the providing may include controlling a display of the refrigerator to display the notification.

In addition, the providing may include transmitting, through a communication interface of the refrigerator, the notification to a server that communicates with an electronic apparatus so that the notification is displayed on the electronic apparatus.

In the meantime, the method may further include identifying a weight of an object for storage in the storage compartment at a predetermined time interval after the user command is input, and based on the identified weight of the object for storage being less than or equal to a preset weight, providing a notification to request input of a user command to return the temperature of the storage compartment to the first temperature.

Here, the providing may include transmitting the notification to the server communicating with the electronic apparatus through the communication interface so that the notification is displayed on the electronic apparatus.

In the meantime, the returning may include, based on a user command to return the temperature of the storage compartment to the first temperature being input before the certain period of time elapses, returning the temperature of the storage compartment to the first temperature based on the temperature of the storage compartment sensed by the temperature sensor.

In addition, the returning may include, based on a user command to extend the certain period of time being input before the certain period of time elapses, returning the temperature of the storage compartment to the first temperature based on the temperature of the storage compartment sensed by the temperature sensor.

In the meantime, the returning may include identifying whether to extend the certain period of time based on a weight of the object for storage in the storage compartment and based on identifying that the certain period of time is to be extended, if the extended time elapses, returning internal temperature of the storage compartment to the first temperature based on the internal temperature of the storage compartment sensed by the temperature sensor.

In this case, the identifying may include, based on identifying that the weight of the object for storage in the storage compartment increases or is not changed, identifying that the certain period of time is to be extended.

Effect of Invention

According to various embodiments of the disclosure, a refrigerating compartment which is a space for storing a refrigerated food may be used as a freezing compartment for a certain period of time and thus, a space for freezing storage may be additionally secured.

When a schedule for short-term freezing storage of food which requires short-term freezing storage elapses, a notification may be given to a user to adjust or release the period.

In that a time for using a refrigerating compartment as a freezing compartment based on an object for storage is determined, convenience of a user of a refrigerator may be improved.

MODE FOR INVENTION

Figure 1A:
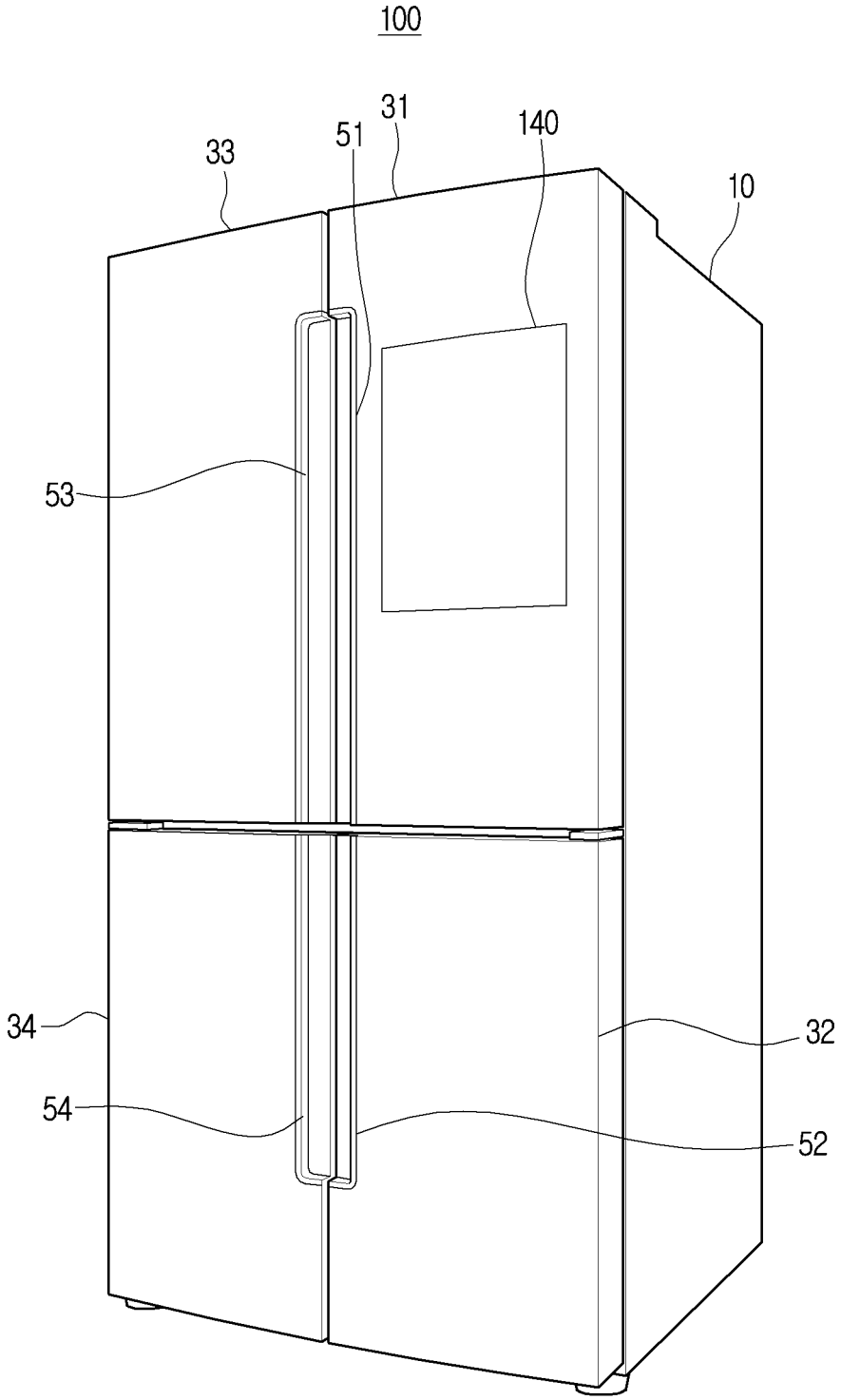
FIGS. 1A to 1D are diagrams illustrating a refrigerator according to an embodiment of the disclosure.

The disclosure includes various embodiments, some of which are illustrated in the drawings and described in detail in the detailed description. However, this disclosure is not intended to limit the embodiments described herein but includes various modifications, equivalents, and/or alternatives. In the context of the description of the drawings, like reference numerals may be used for similar components.

In describing the disclosure, a detailed description of known functions or configurations incorporated herein will be omitted as it may make the subject matter of the disclosure unclear.

In addition, the embodiments described below may be modified in various different forms, and the scope of the technical concept of the disclosure is not limited to the following embodiments. Rather, these embodiments are provided so that this disclosure will be thorough and complete, and will fully convey the scope of the disclosure to those skilled in the art.

The terms used in this disclosure are used merely to describe a particular embodiment, and are not intended to limit the scope of the claims. The expression of a singular includes a plurality of representations, unless the context clearly indicates otherwise.

In this document, the expressions "have," "may have," "including," or "may include" may be used to denote the presence of a feature (e.g., a component, such as a numerical value, a function, an operation, a part, or the like), and does not exclude the presence of additional features.

The expressions "A or B," "at least one of A and/or B," or "one or more of A and/or B," and the like include all possible combinations of the listed items. For example, "A or B," "at least one of A and B," or "at least one of A or B" includes (1) at least one A, (2) at least one B, (3) at least one A and at least one B all together.

In addition, expressions "first", "second", or the like, used in the disclosure may indicate various components regardless of a sequence and/or importance of the components, will be used only in order to distinguish one component from the other components, and do not limit the corresponding component.

It is to be understood that an element (e.g., a first element) is "operatively or communicatively coupled with/to" another element (e.g., a second element) is that any such element may be directly connected to the other element or may be connected via another element (e.g., a third element).

On the other hand, when an element (e.g., a first element) is "directly connected" or "directly accessed" to another element (e.g., a second element), it may be understood that there is no other element (e.g., a third element) between the other elements.

Herein, the expression "configured to" may be used interchangeably with, for example, "suitable for," "having the capacity to," "designed to," "adapted to," "made to," or "capable of." The expression "configured to" does not necessarily mean "to be specific designed to" in a hardware sense.

Instead, under some circumstances, "a device configured to" may indicate that such a device can perform an action along with another device or part. For example, the expression "a processor configured to perform A, B, and C" may indicate an exclusive processor (e.g., an embedded processor) to perform the corresponding action, or a generic-purpose processor (e.g., a central processor (CPU) or application processor (AP)) that can perform the corresponding actions by executing one or more software programs stored in the memory device.

The terms such as "module," "unit," "part", and so on are used to refer to an element that performs at least one function or operation, and such element may be implemented as hardware or software, or a combination of hardware and software. Further, except for when each of a plurality of "modules", "units", "parts", and the like needs to be realized in an individual hardware, the components may be integrated in at least one module or chip and be realized in at least one processor.

The various elements and regions in the drawings are schematically drawn. Accordingly, the technical spirit of the disclosure is not limited by the relative size or spacing depicted in the accompanying drawings.

Hereinafter, with reference to the attached drawings, embodiments will be described in detail so that those skilled in the art to which the disclosure belongs to can easily make and use the embodiments.

FIGS. 1A to 1D are diagrams illustrating a refrigerator according to an embodiment of the disclosure.

A refrigerator 100 is a device that may maintain freshness of various foods stored in the refrigerator 100 for a long period of time by providing cool air generated based on a cooling cycle to a refrigerating compartment and a freezing compartment.

Figure 1B:
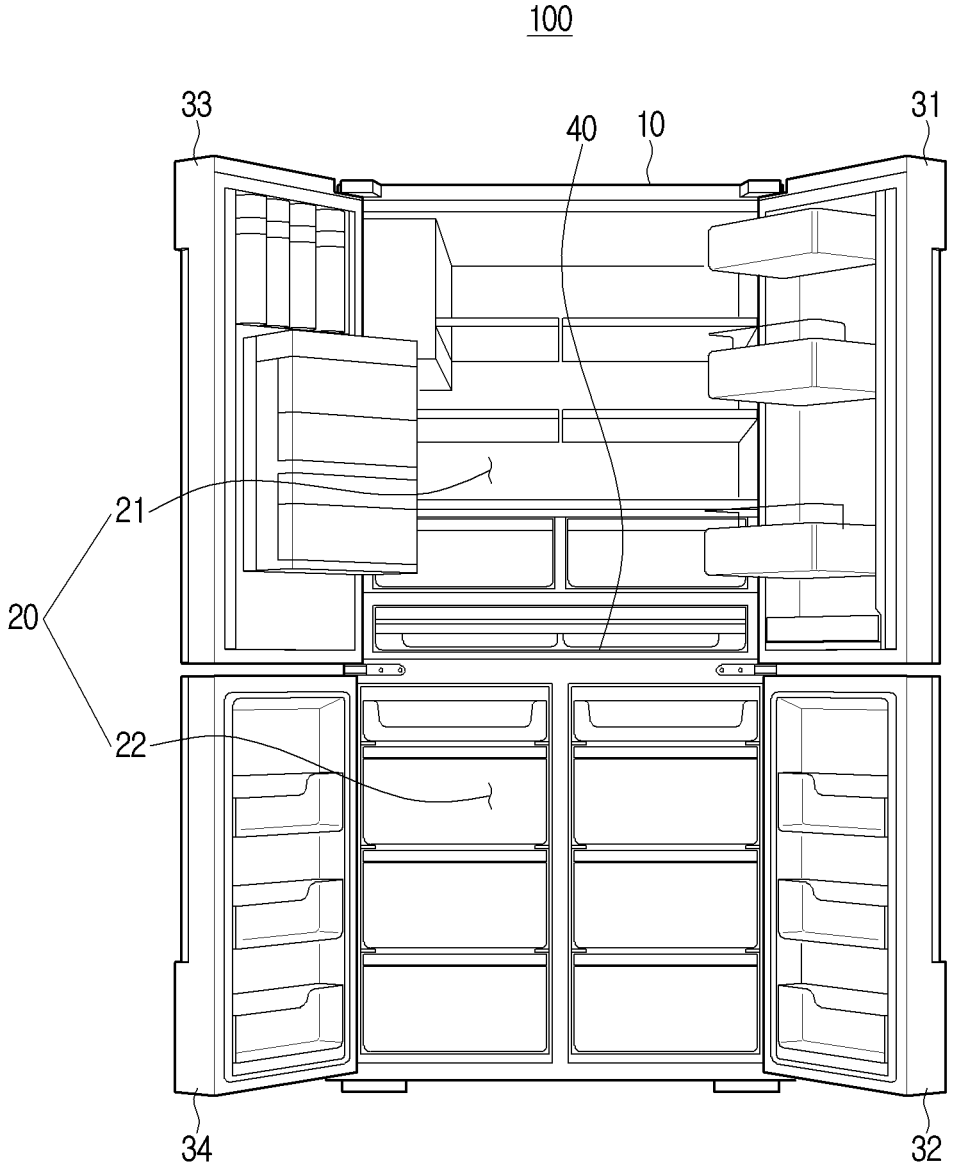

In this case, as illustrated in FIGS. 1A and 1B, the refrigerator 100 may include a main body 10, a refrigerating compartment 21, a freezing compartment 22, and doors 31 to 34.

The main body 10 may include an outer case forming the exterior of the refrigerator 100 and an inner case forming the refrigerating compartment 21 and the freezing compartment 22. In this case, an insulating material may be included between the inner case and the outer case. The insulating material may prevent cool air inside the refrigerator 100 from leaking to the outside and prevent external warm air from flowing into the refrigerator 100.

The inside of the main body 10 may be divided into a plurality of spaces by a barrier 40, and the refrigerating compartment 21 and the freezing compartment 22 may be formed inside the main body 10. For example, the barrier 40 may be formed in a horizontal direction, and the refrigerating compartment 21 may be located above the barrier 40 and the freezing compartment 22 may be located below the barrier 40.

The doors 31, 32, 33, 34 are rotatably provided to open and close the opened front surface of the main body 10. For this, the doors 31, 32, 33, 34 may be respectively coupled to hinges on both sides of the main body 10 so as to be rotatable in both sides. For example, the doors 31, 33 may be configured to open and close the refrigerating compartment 21, and the doors 32, 34 may be configured to open and close the freezing compartment 22. In addition, door handles 51, 52, 53, 54 may be provided on the doors 31 to 34. Accordingly, the user may open or close the doors 31, 32, 33, 34 through the door handles 51, 52, 53, 54.

An object for storage may be stored in the refrigerating compartment 21 and the freezing compartment 22. Here, the object for storage may include foods. In addition, the object for storage may include various products that need to be stored in a low temperature state like cosmetics, ice pack, or the like, in addition to foods. In this example, the refrigerating compartment 21 and the freezing compartment 22 may include at least one shelf and at least one storage box.

In the meantime, the temperature of the refrigerating compartment 21 may be set to a refrigerating temperature. Here, the refrigerating temperature means the temperature above zero, and for example, may be a temperature between 0° C. and 7° C. In addition, the temperature of the freezing compartment 22 may be set to the freezing temperature. Here, the freezing temperature means a temperature below zero, and for example, may be a temperature between −1° C. and −25° C. Accordingly, a user may store, in the refrigerating compartment 21, an object for storage that needs to be refrigerated and may store an object for storage that needs to be frozen in the freezing compartment 22.

In the above example, it is illustrated that the refrigerator 100 is a four-door type refrigerator, but this is merely exemplary and the type of the refrigerator 100 is not limited thereto.

Figure 1C:
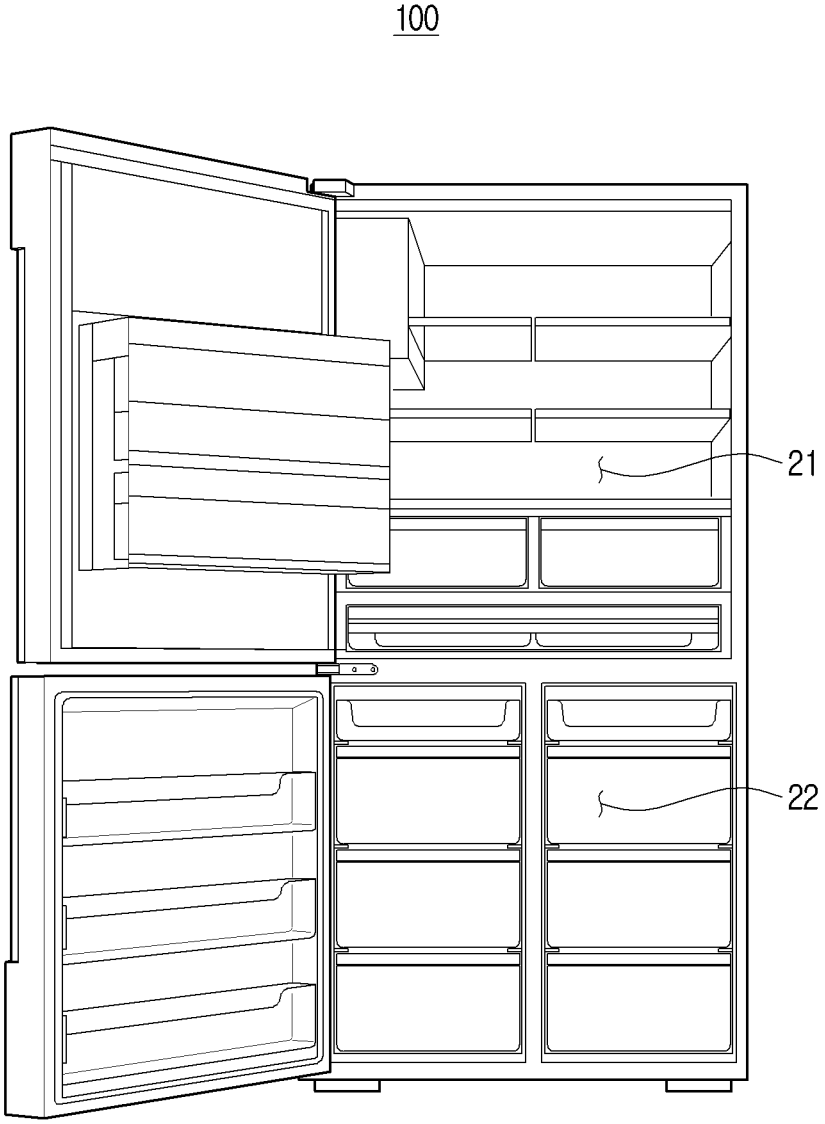
Figure 1D:
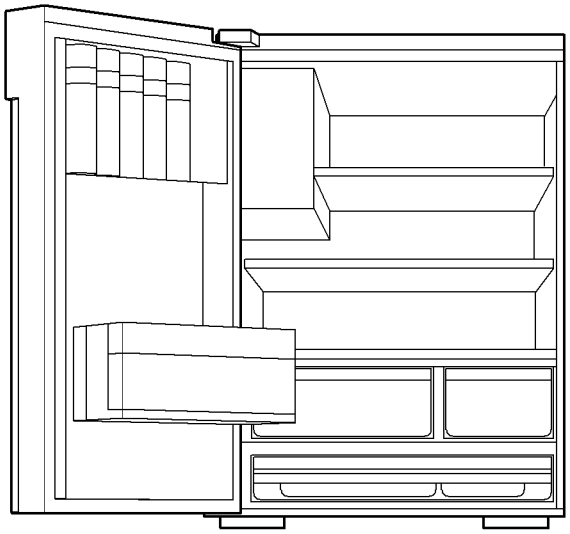

For example, as shown in FIG. 1C, the refrigerator 100 may be a two-door type refrigerator. In this case, an upper space in the refrigerator 100 may be implemented as the refrigerating compartment 21, and a lower space in the refrigerator 100 may be implemented as the freezing compartment 22. As another example, as shown in FIG. 1D, the refrigerator 100 may be a one-door type refrigerator. In this case, the space in the refrigerator 100 may perform the functions of the refrigerating compartment 21 or the freezing compartment 22.

In addition, the refrigerator 100 may be implemented with a refrigerator of various types like a French door type, a three-door type, or the like.

In the meantime, the refrigerator 100 may include a display 140. In this case, the display 140 may be located in at least one of a plurality of doors 31, 32, 33, 34.

The display 140 may display various screens. For example, the display 140 may display information related to setting and a function of the refrigerator 100 or display a notification.

The display 140 may be implemented as a touch screen. In this case, the refrigerator 100 may receive various user commands through a touch operation on the touch screen. However, according to an embodiment, the refrigerator 100 may include a touch panel and a physical button to receive various user commands.

In the meantime, the refrigerator 100 may provide a notification to an external device or receive various user commands for controlling the refrigerator from an external device. For this, the refrigerator 100 may include a communication interface (not shown). The communication interface includes a Wi-Fi communication module and may communicate with an external device by using a Wi-Fi communication method.

Accordingly, the refrigerator 100 may communicate with an external device by using a communication interface and this will be described in detail with reference to FIG. 2.

A server (or cloud server) 300 may control and manage various devices (e.g., household device and Internet of Things (IoT) device, etc.) registered in the server 300. At this time, the server 300 may register a device by user accounts.

To be specific, the electronic apparatus 200 may, when an application installed in the electronic apparatus 200 is executed, access the server 300 through wireless network. In this case, the electronic apparatus 200 may, when a user account is input, log in the server 300 through the input user account. Accordingly, the electronic apparatus 200 may access the server 300 based on the logged in user account.

In the meantime, the refrigerator 100 may operate as an access point (AP) mode according to an input use command. In this case, the electronic apparatus 200 may search an AP for communication connection around the electronic apparatus 200 and may be communicatively connected to the refrigerator 100 functioning with an AP mode. In addition, the electronic apparatus 200 may transmit information about communication connection with the AP 400 to the refrigerator 100. For this, the electronic apparatus 200 may prestore information for communication connection with the AP 400. For example, the electronic apparatus 200 may, when communication connection with the AP 400 is performed before communication connection with the refrigerator 100, obtain information (e.g., SSID of AP, password, etc.) for communication connection with the AP 400 in the process of performing communication connection with the AP 400.

Accordingly, when the refrigerator 100 is connected to the electronic apparatus 200, the refrigerator 100 may receive information for communication connection with the AP 400. In addition, the refrigerator 100 may transmit information (e.g., device information, etc.) about the refrigerator 100 to the electronic apparatus 200.

In the meantime, the electronic apparatus 200 may, when receiving information about the refrigerator 100, register the refrigerator 100 to a user account by transmitting the received information about the refrigerator 100 to the server 300 through wireless network or access point 400.

In addition, the refrigerator 100 may perform communication connection with the access point 400 by using the received information for communication connection with the access point 400, and may access the server 300 through the access point 400. In this case, the information (e.g., network address, etc.) for the refrigerator 100 to access the server 300 may be prestored in the refrigerator 100.

According to the above method, when the refrigerator 100 is registered in the user account and the refrigerator 100 access the server 300, the refrigerator 100 and the electronic apparatus 200 may transceiver data through the server 300.

For example, the refrigerator 100 may transmit various notifications to the electronic apparatus 200 through the server 300 and the electronic apparatus 200 may transmit various commands to control the refrigerator 100 to the refrigerator 100 through the server 300.

Figure 2:
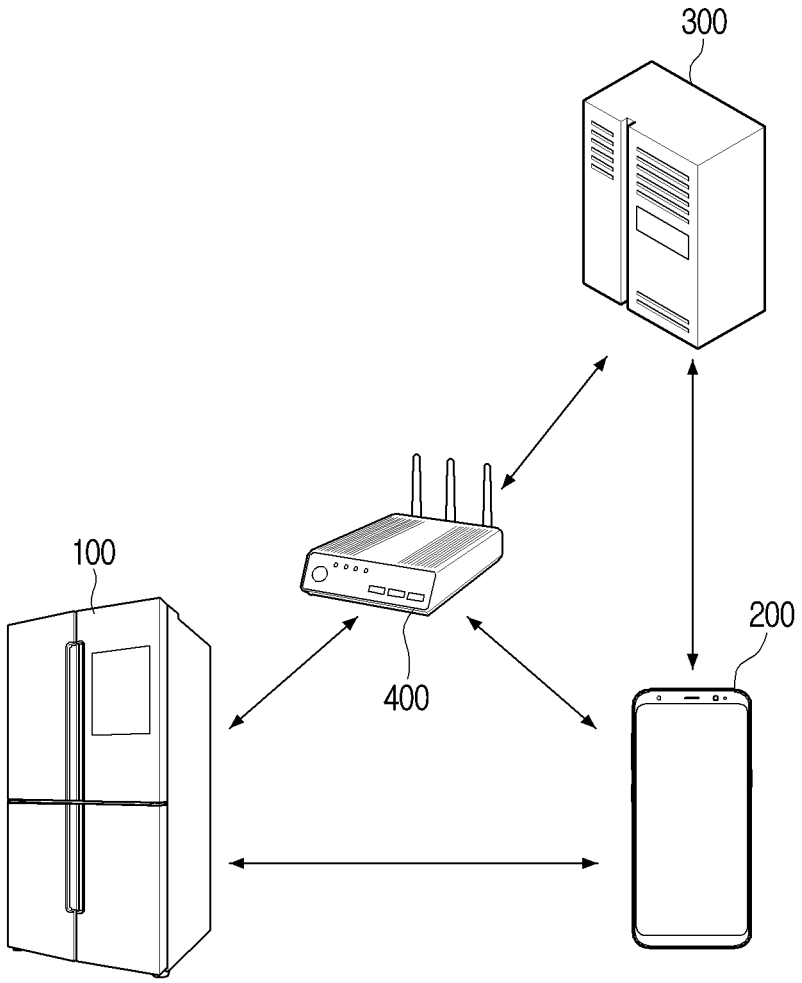
FIG. 2 is a view illustrating a refrigerator in which a refrigerator communicates with an external device according to an embodiment of the disclosure.

In the meantime, the method as illustrated in FIG. 2 is merely an example, and the refrigerator 100 may perform communication with an external device through various methods.

Figure 3:
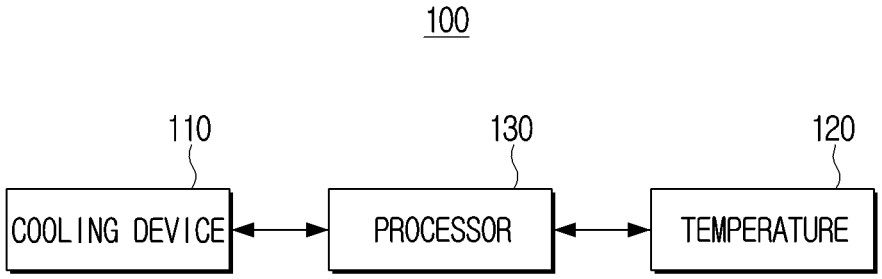
FIG. 3 is a block diagram illustrating a configuration of a refrigerator according to an embodiment of the disclosure.

FIG. 3 is a block diagram illustrating a configuration of a refrigerator according to an embodiment of the disclosure.

Referring to FIG. 3, the refrigerator 100 includes a cooling device 110, a temperature sensor 120, and a processor 130.

The cooling device 110 may supply cool air to the refrigerator 100. To be specific, the cooling device 110 may, in order to control the temperature of the refrigerating compartment 21 and the freezing compartment 22, supply cool air generated by the cooling cycle to the refrigerating compartment 21 and the freezing compartment 22.

Figure 4:
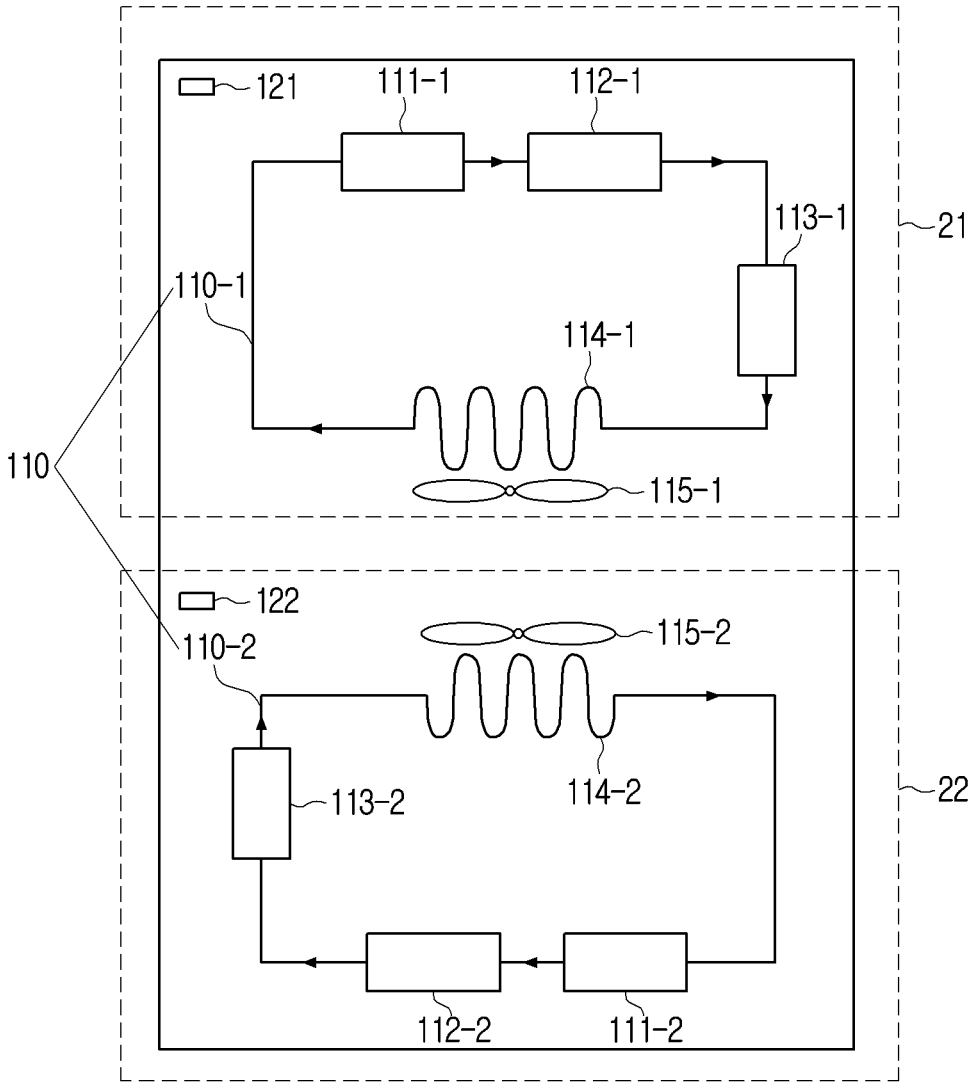
FIG. 4 is a diagram illustrating a cooling device according to an embodiment of the disclosure.

For this, as illustrated in FIG. 4, the cooling device 110 may include a first cooling device 110-1 for controlling the temperature of the refrigerating compartment 21 and a second cooling device 110-2 for controlling the temperature of the freezing compartment 22.

The first cooling device 110-1 may provide cool air to the refrigerating compartment 21. For this, the first cooling device 110-1 may include a compressor 111-1, a condenser 112-1, an expansion member 113-1, an evaporator 114-1, and a fan 115-1.

To be specific, the compressor 111-1 may compress a refrigerant. The condenser 112-1 may condense the compressed refrigerant, and the refrigerant that passed the condenser 112-1 may be expanded by the expansion member 113-1. The evaporator 114-1 may evaporate expanded refrigerant. In this case, the cool air cooled by evaporation of the refrigerant may be introduced into the refrigerating compartment 21 by rotation of a fan 115-1. Accordingly, the temperature of the refrigerating compartment 21 may be adjusted.

The second cooling device 110-2 may provide cool air to the freezing compartment 22. For this, the second cooling device 110-2 may include a compressor 111-2, a condenser 112-2, an expansion member 113-2, an evaporator 114-2, and a fan 115-2.

To be specific, the compressor 111-2 may compress a refrigerant. The condenser 112-2 may condense the compressed refrigerant, and the refrigerant that passed the condenser 112-2 may be expanded by the expansion member 113-2. The evaporator 114-2 may evaporate expanded refrigerant. In this case, the cool air cooled by evaporation of the refrigerant may be introduced into the freezing compartment 22 by rotation of a fan 115-2. Accordingly, the temperature of the freezing compartment 22 may be adjusted.

As such, the cooling device 110 may individually supply cool air to the refrigerating compartment 21 and the freezing compartment 22, and accordingly, the temperature of the refrigerating compartment 21 and the freezing compartment 22 may be individually controlled.

The temperature sensor 120 may sense temperature inside the refrigerator 100. To be specific, the temperature sensor 120 may include the temperature sensor 121 for sensing temperature of the refrigerating compartment 21 and the temperature sensor 122 for sensing temperature of the freezing compartment 22.

The processor 130 may be electrically connected to the cooling device 110 and the temperature sensor 120 and may control overall operations and functions of the refrigerator 100.

For this, the processor 130 may include a central processing unit (CPU) or the like. In this case, the processor 130 may execute one or more software programs stored in the memory according to one or more instructions to control operations of various hardware provided in the refrigerator 100 and support various functions.

The processor 130 may control the cooling device 110 to maintain the temperature of the refrigerating compartment 21 and the freezing compartment 22 to the set temperature (that is, control temperature).

To be specific, the processor 130 may, in order to maintain the temperature inside the refrigerating compartment 21 to the set temperature of the refrigerating compartment 21, control the first cooling device 110-1 based on the temperature sensed by the temperature sensor 121. In this case, for example, the processor 130 may control at least one of the cooling power of the compressor 111-1 and the rotation speed of the pen 151-1.

In addition, the processor 130 may, in order to maintain the temperature inside the freezing compartment 22 to the set temperature of the freezing compartment 22, control the second cooling device 110-2 based on the temperature sensed by the temperature sensor 122. In this case, for example, the processor 130 may control at least one of the cooling power of the compressor 112-2 and the rotation speed of the pen 152-2.

In the meantime, according to an embodiment of the disclosure, the processor 130 may change the set temperature of the refrigerating compartment 21 to the freezing temperature for a certain period of time. That is, the processor 130 may change the set temperature of the refrigerating compartment 21 to the freezing temperature for a certain period of time to cool the object for storage of the refrigerating compartment 21 to the freezing temperature, and when a certain period of time elapses (or passes), the processor 130 may change the set temperature of the refrigerating compartment 21 to the refrigerating temperature again and may cool the object for storage of the refrigerating compartment 21 to the refrigerating temperature.

As such, according to an embodiment of the disclosure, a user may use a refrigerating compartment which is a space for storing a refrigerating food as a freezing compartment for a certain period of time and thus may additionally secure a space for freezing storage.

Hereinafter, with reference to the attached drawings, a method of using a refrigerating compartment as a freezing compartment for a certain period of time will be described in greater detail.

Figure 5:
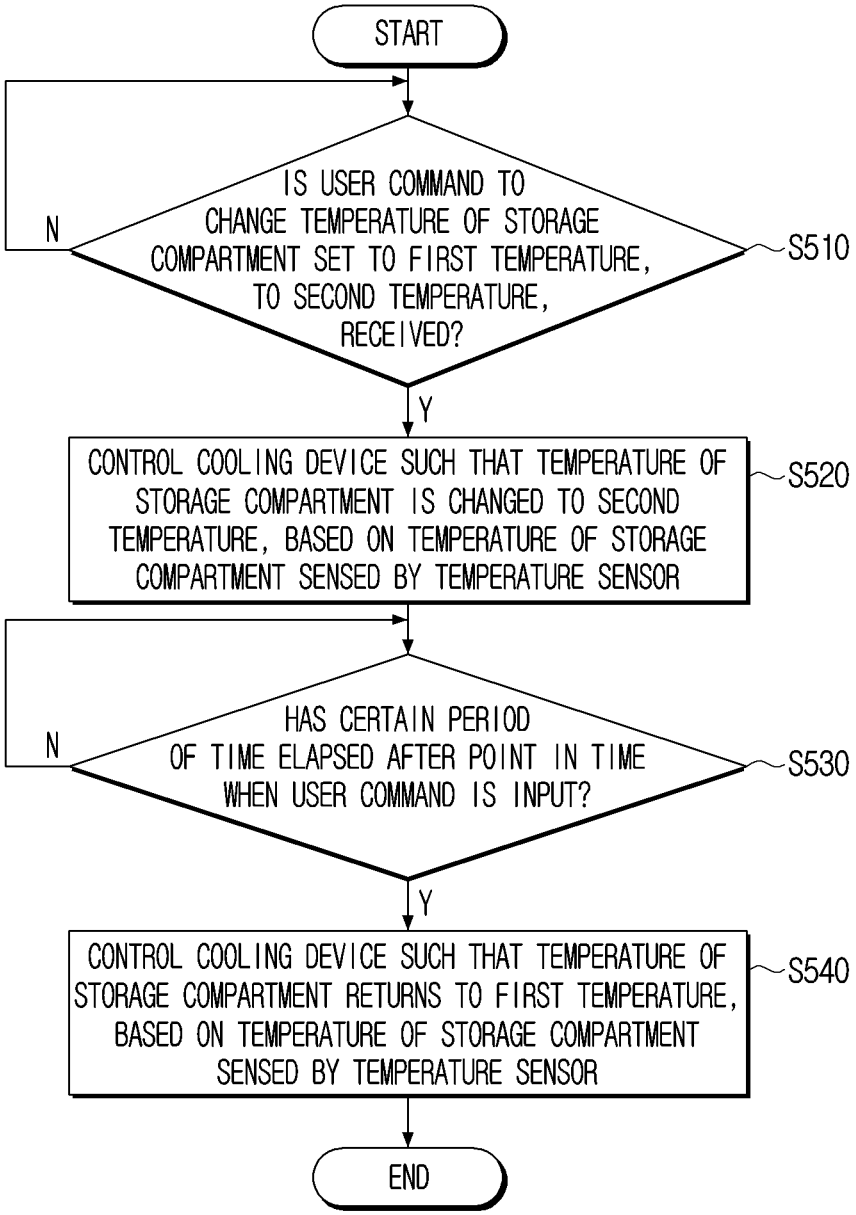
FIG. 5 is a flowchart illustrating a method for controlling a temperature of a refrigerator according to an embodiment of the disclosure.

FIG. 5 is a flowchart illustrating a method for controlling a temperature of a refrigerator according to an embodiment of the disclosure.

First of all, the processor 130 may receive a user command to change the temperature of the storage compartment set to the first temperature, to the second temperature in operation S510.

Here, the storage compartment may mean the refrigerating compartment 21.

The first temperature may mean the temperature set to the storage compartment to provide an intrinsic function of the storage compartment.

For example, the refrigerating compartment 21 is a space for storing refrigerated food, and the set temperature of the refrigerating compartment 21 may be a refrigerating temperature. Accordingly, when the storage compartment is the refrigerating compartment 21, the first temperature may be a refrigerating temperature.

In addition, the second temperature may be the temperature to make the storage compartment to perform another function, not an intrinsic function.

Here, another function may mean a function for storing frozen food in the case of a refrigerating compartment. Therefore, when the storage compartment is the refrigerating compartment 21, the second temperature may be a freezing temperature. Here, the second temperature may be preset in a manufacturing stage of the refrigerator 100.

In addition, according to an embodiment, the second temperature may be set and changed according to a user command. To be specific, when a user command for setting a second temperature is input, the processor 130 may set a second temperature based on the input user command.

In the meantime, a user command to change the temperature of the storage compartment may be input through various methods.

For example, when the display 140 is implemented with a touch screen, the user command may be input by a touch manipulation for the display 140.

Figure 6A:
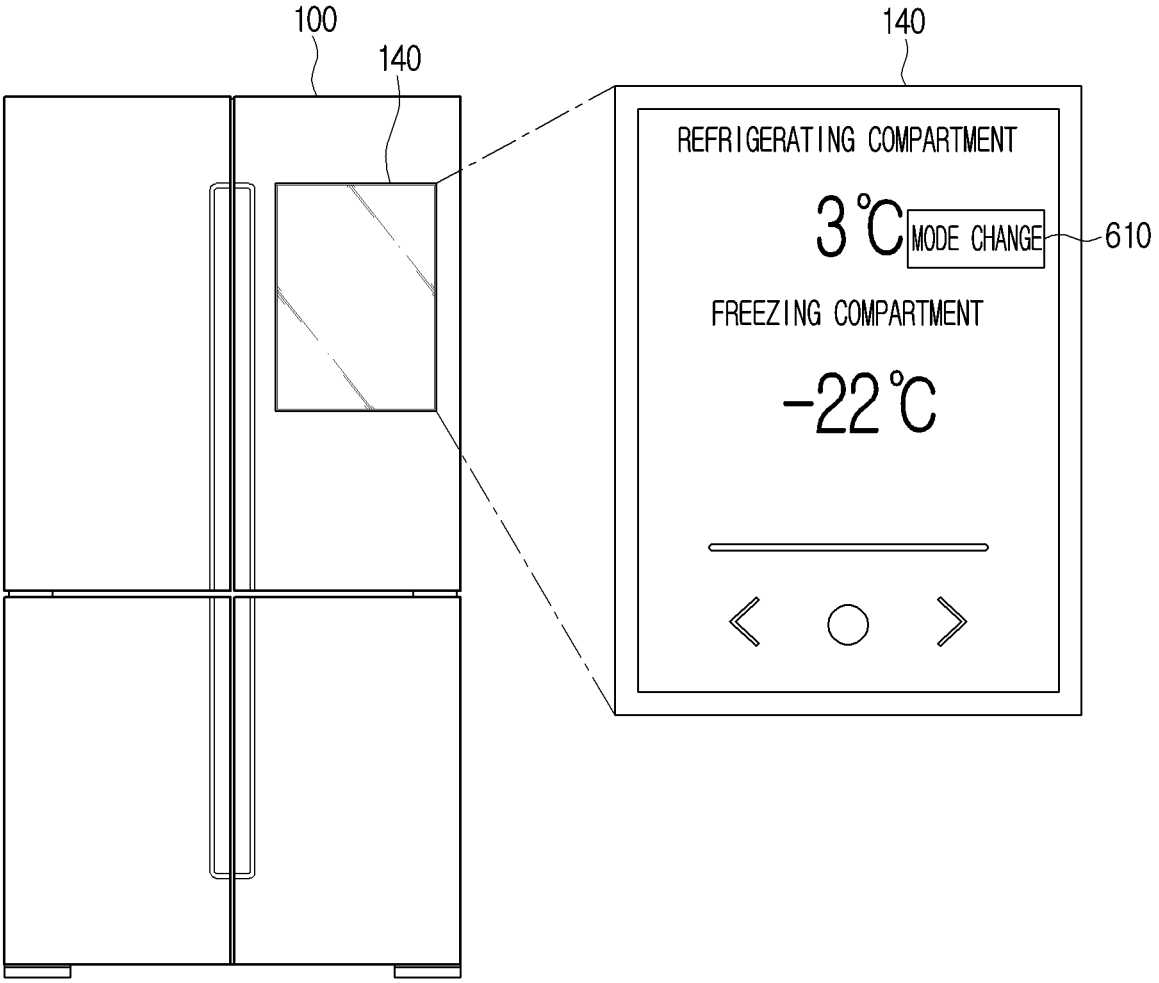
FIGS. 6A to 6D are views illustrating receiving an input of a user command by a refrigerator according to an embodiment of the disclosure.

For this, as an example, as shown in FIG. 6A, the processor 130 may display a menu button 610 for receiving a user command on the display 140. In this case, according to an embodiment, the processor 130 may display, on the display 140, information about the refrigerator 100, for example, information about the current temperature of the refrigerating compartment 21, the current temperature of the freezing compartment 22, and the like. Accordingly, the user may touch a menu button 610 to input a user command for changing the set temperature of the refrigerating compartment 21 to the freezing temperature for a certain period of time. However, this is an example, and the processor 130 may receive a user command for changing the set temperature of the refrigerating compartment 21 to the freezing temperature for a certain period of time through a physical button provided in the refrigerator 100 or a button provided on the touch panel.

As another example, a user command may be input through the electronic apparatus 200.

Figure 6B:
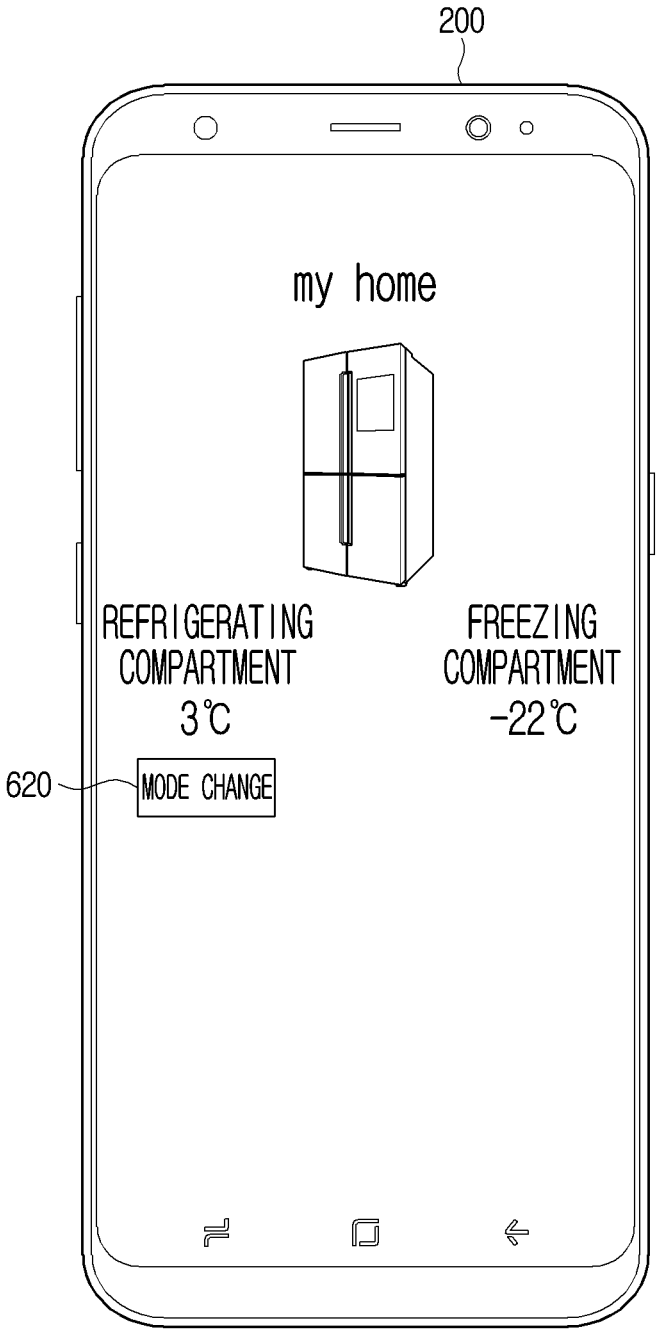

To be specific, when an application installed in the electronic apparatus 200 is executed, the electronic apparatus 200 may access the server 300 through a wireless network. Referring to FIG. 6B, the electronic apparatus 200 may display a menu button 620 for receiving a user command through an application execution screen. In this case, according to an embodiment, the electronic apparatus 200 may display, through the server 300, information about the refrigerator 100 received from the refrigerator 100, for example, information about the current temperature of the refrigerating compartment 21, the current temperature of the freezing compartment 22, and the like. When the menu button 620 is selected, the electronic apparatus 200 may transmit a user command for changing the set temperature of the refrigerating compartment 21 to the freezing temperature for a certain period of time through the server 300 to the refrigerator 100. Accordingly, the processor 130 may receive a user command from the electronic apparatus 200.

In the meantime, the processor 130 may, based on a user command to change a temperature of the storage compartment set to the first temperature, to the second temperature, being input in operation S510-Y, control the cooling device 110 such that the temperature of the storage compartment is changed to the second temperature based on the temperature of the storage compartment sensed by the temperature sensor 120 in operation S520.

To be specific, the processor 130 may control the first cooling device 110-1 such that the temperature of the refrigerating compartment 21 is lowered to the second temperature and then the second temperature is maintained, based on the temperature of the refrigerating compartment 21 sensed by the temperature sensor 121. That is, the temperature of the refrigerating compartment 21 sensed by the temperature sensor 121 is higher than the freezing temperature in that the refrigerating compartment 21 is set to a refrigerating temperature. Therefore, the processor 130 may control the first cooling device 110-1 to lower the temperature of the cool air supplied to the refrigerating compartment 21 to control the refrigerating compartment 21 to be driven at the freezing temperature. Meanwhile, in the disclosure, the driving of the refrigerating compartment 21 to the freezing temperature may mean supplying the cool air to the refrigerating compartment 21 through the first cooling device 110-1 so that the object for storage of the refrigerating compartment 21 may be stored or cooled at a temperature below zero.

In the meantime, the processor 130 may, based on a certain period of time elapsing after the point in time when the user command is input in operation S530-Y, control the cooling device 110 such that the temperature of the storage compartment returns to the first temperature based on the temperature of the storage compartment sensed by the temperature sensor 120 in operation S540.

More to be specific, the processor 130 may control the first cooling device 110-1 to increase the temperature of the refrigerating compartment 21 to a first temperature and then maintain the first temperature based on the temperature of the refrigerating compartment 21 sensed by the temperature sensor 121 when a certain period of time has elapsed. That is, the temperature of the refrigerating compartment 21 sensed by the temperature sensor 121 is lower than the refrigerating temperature in that the refrigerating compartment 21 is set to the refrigerating temperature. Therefore, the processor 130 may control the first cooling device 110-1 to increase the temperature of the cool air supplied to the refrigerating compartment 21 to control the refrigerating compartment 21 to be driven again at the refrigerating temperature. Meanwhile, in the disclosure, the driving of the refrigerating compartment 21 to the refrigerating temperature may mean supplying the cool air to the refrigerating compartment 21 through the first cooling device 110-1 so that the object for storage of the refrigerating compartment 21 may be stored or cooled at the temperature above zero.

Meanwhile, the certain period of time may be preset in a manufacturing stage of the refrigerator 100 in advance. In this case, the certain period of time may be set in consideration of the type, model, capacity, etc. of the refrigerator 100. For example, the certain period of time may be set to different periods depending on the type, model, capacity, etc. of the refrigerator 100. However, this is an example, and a certain period of time may be set to the same period regardless of the foregoing.

In addition, according to an embodiment, the certain period of time may be set based on a location (e.g., country) of the refrigerator 100.

To be specific, information about time during which the refrigerating compartment 21 is driven at the freezing temperature for each location has been prestored. In this case, the processor 130 may determine the location of the refrigerator 100 and may set, as the time to correspond to the determined location, the certain period of time during which the refrigerating compartment 21 is driven at a freezing temperature. At this time, the processor 130 may determine the location of the refrigerator 100 based on the user account registered in the server 300. That is, in a process of registering the user account, a user may set a country at which the user is located. Accordingly, the processor 130 may receive information about the user account in which the refrigerator 100 is registered from the server 300 and may determine the location of the refrigerator 100 by using the received information.

In addition, according to an embodiment, the certain period of time may be set based on a user command. To be specific, the processor 130 may set the certain period of time based on the input user command if the user command to set the certain period of time is input.

Here, the range of the certain period of time set by the user command may be preset in the manufacturing stage of the refrigerator 100. That is, the certain period of time that may be set by the user may be a time within a time range preset in the manufacturing stage.

Figure 6C:
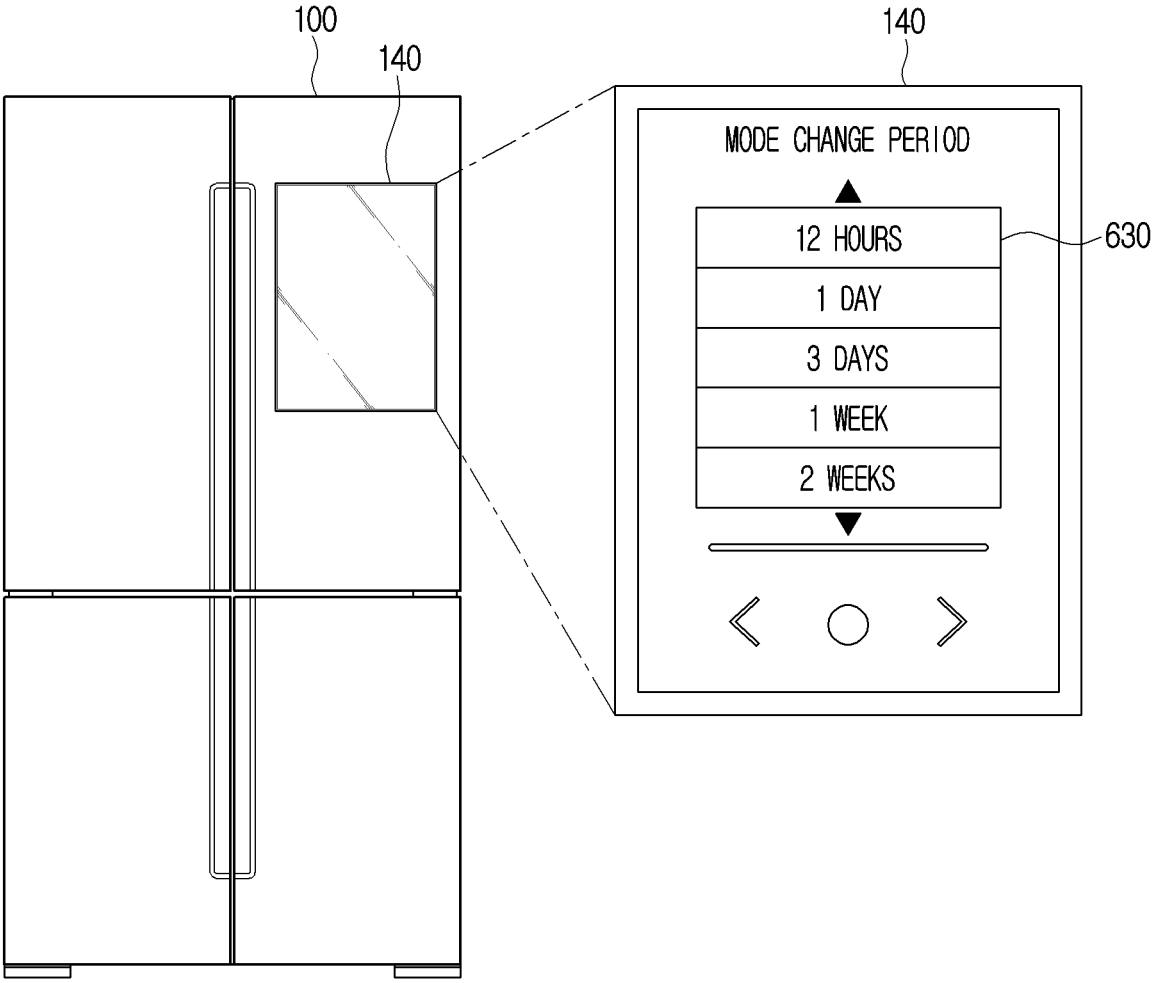

For example, as illustrated in FIG. 6C, the processor 130 may display a time selection user interface (UI) 630 for setting a certain period of time on the display 140. In this case, the time range displayed in the time selection (or setting) UI 630 may have a range from 12 hours to four weeks. In this case, when the user selects "one week" through the time selection UI 630, the certain period of time may be set to one week.

In the meantime, in the aforementioned example, the certain period of time is set based on selection of the time displayed on the display 140 by the user, but the certain period of time may be set based on the time directly input by the user. In this case, when the time directly input by the user is beyond the range of the certain period of time, the processor 130 may set the certain period of time as the time within the certain period of time set by the user command.

To be specific, when the time set by the user command is less than the range of the certain period of time that may be set by the user command, the processor 130 may set the time having a minimum value among the time of the range of the certain period of time that may be set by the user command to the certain period of time.

In addition, when the time input by the user command is greater than the time of the preset range in the manufacturing stage, the processor 130 may set the time having a greatest value among the range of the certain period of time that may be set by the user command to the certain period of time.

Figure 6D:
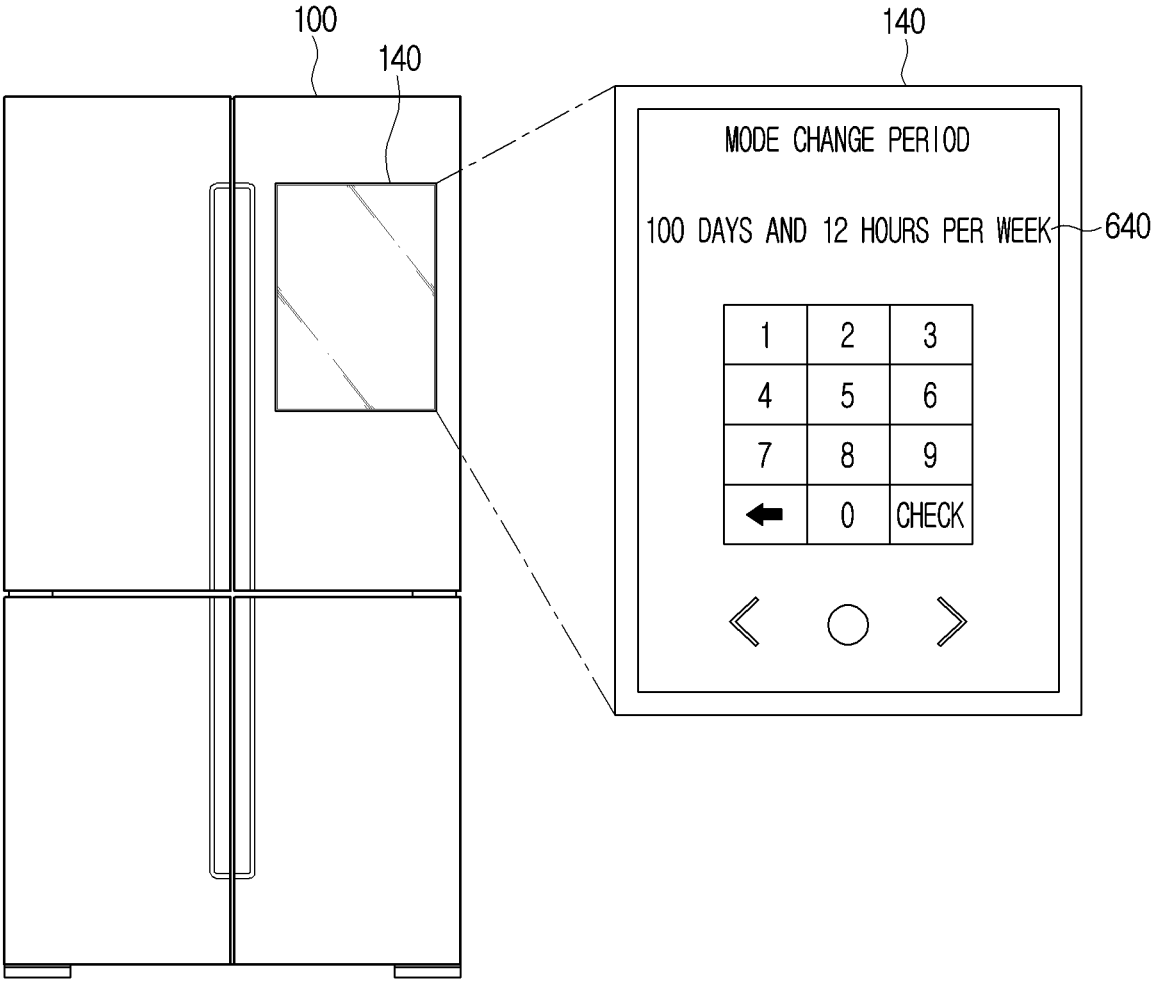

For example, it may be assumed that the range of the certain period of time that may be set by the user command is set from one day to 50 days. In addition, as illustrated in FIG. 6D, the processor 130 may display a time input UI 640 for setting the certain period of time on the display 140. In this case, the time input UI 640 may include a UI for setting the certain period of time by times. Accordingly, the user may input the user command to set the certain period of time to 100 days and 12 hours by a touch of the time input UI 640.

In this case, the time input by the user is greater than the range of the certain period of time that may be set by the user command. Accordingly, the processor 130 may set the time, which is 50 days, having the maximum value among the range of the certain period of time that may be set by the user command to the certain period of time.

As such, according to an embodiment, when only a user command for changing the temperature of the storage compartment set to the first temperature, to the second temperature is input, and a user command for setting the certain period of time is not input, the certain period of time may be preset in the manufacturing stage or may be set based on the location of the refrigerator 100.

On the contrary, when a user command to set the certain period of time is input along with a user command to change the temperature of the storage compartment set to the first temperature, to the second temperature, the certain period of time may be set based on the time input by the user.

In addition, the refrigerator 100 may perform a function (for convenience, hereinafter referred to as a mode change function) to drive the refrigerating compartment 21 as the freezing compartment during the certain period of time according to a user command and when the certain period of time elapses, then automatically drive the refrigerating compartment 21 to a refrigerating chamber again.

Meanwhile, according to an embodiment, the refrigerator 100 may provide a user with a notification that the set temperature of the refrigerating compartment 21 will be changed again to the refrigerating temperature before the certain period of time elapses, and this will be described in greater detail below with reference to the accompanying drawings.

Figure 7:
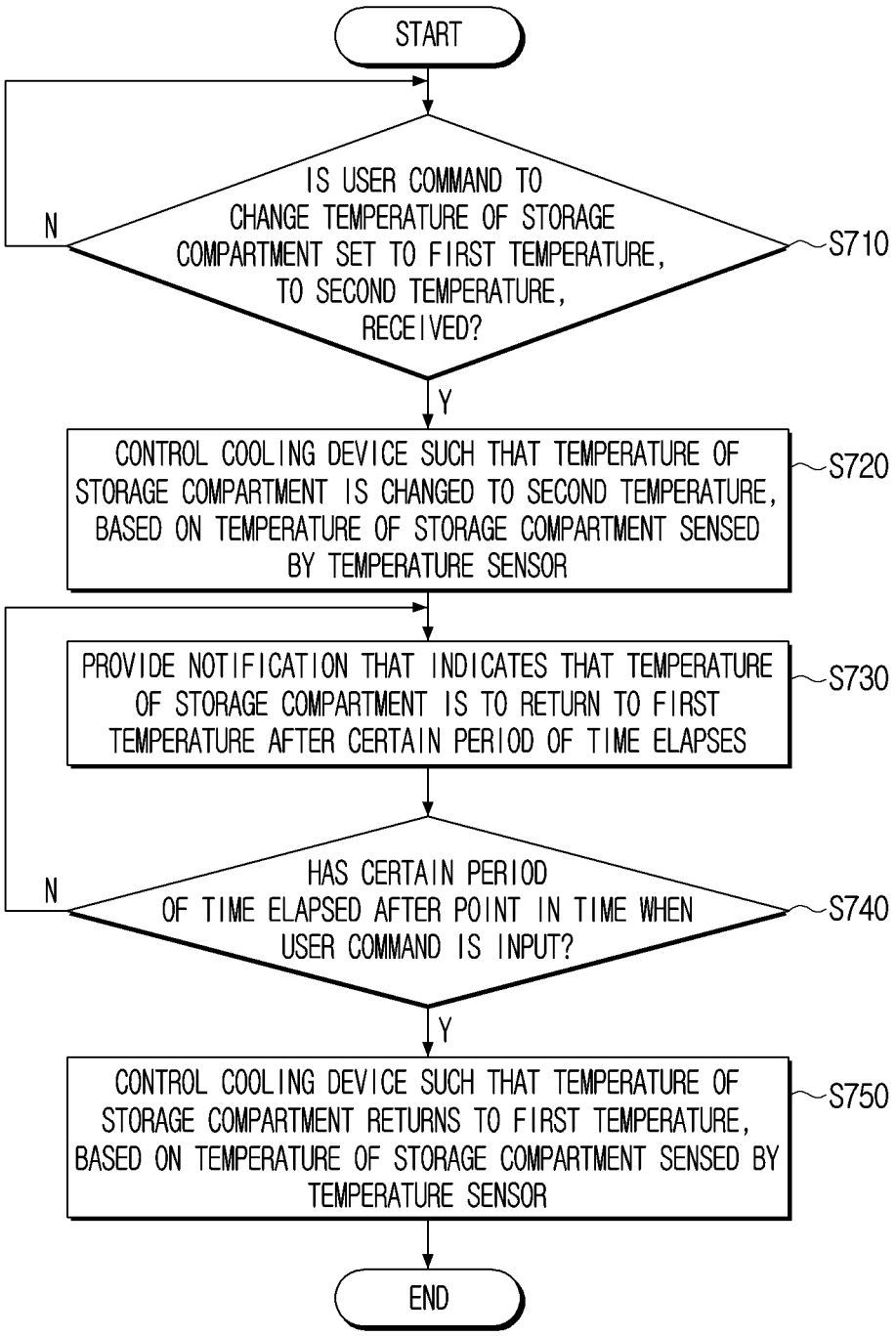
FIG. 7 is a flowchart illustrating a method for providing a notification by a refrigerator according to an embodiment of the disclosure.

FIG. 7 is a flowchart illustrating a method for providing a notification by a refrigerator according to an embodiment of the disclosure.

Since S710, S720, S740, S750 of FIG. 7 are the same as S510, S520, S530, S540 of FIG. 5, a duplicate description will be omitted.

The processor 130 may, before the certain period of time elapses, provide a notification that indicates that the temperature of the storage compartment is to return to the first temperature in operation S730.

To be specific, the processor 130 may, before the certain period of time elapses, provide a notification that indicates that the temperature of the storage compartment is to return to the first temperature at a predetermined time interval.

In this case, the processor 130 may provide a notification at a predetermined time interval from a certain point in time before the certain period of time elapses. Here, the certain point in time may mean a specific point in time prior to a point in time at which the certain period of time elapses. For example, it is assumed that the refrigerating compartment 21 is driven to the freezing temperature for four weeks from the point in time at which the user command is input. In this case, the processor 130 may, when three weeks are elapsed after the user command is input, provide a notification in an interval of two days.

Meanwhile, the notification may include various contents.

To be specific, the notification may include information indicating that the temperature of the storage compartment will return to the first temperature. In this case, the notification may further include information (for example, information about remaining time from the point in time at which notification is provided to the point in time at which the temperature of the storage compartment returns to the first temperature, information about date when the temperature of the storage compartment returns to the first temperature, etc.) about the point in time at which the temperature of the storage compartment will return to the first temperature.

In addition, the notification may be provided through various methods.

Figure 8A:
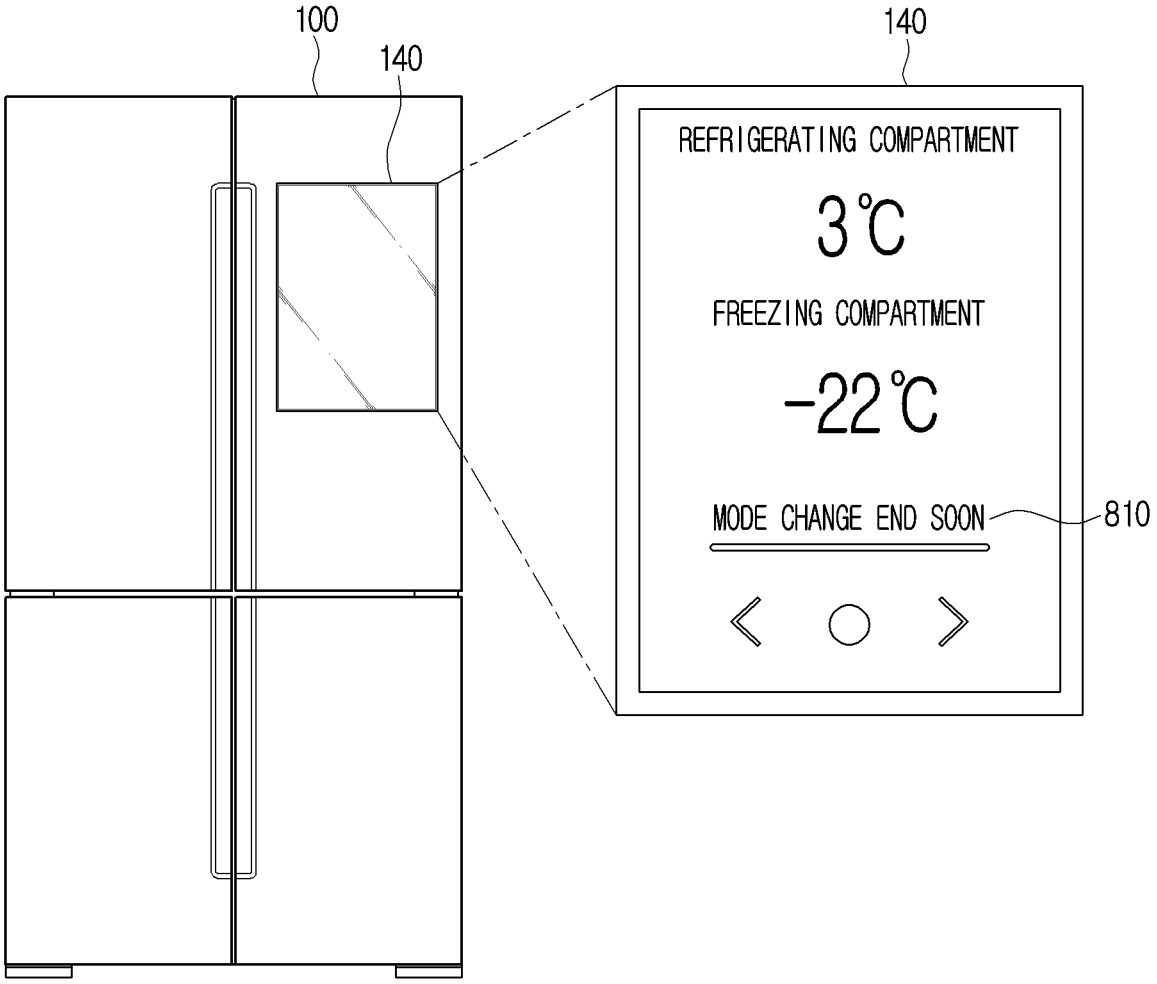
FIGS. 8A to 8C are diagrams illustrating a method for providing a notification by a refrigerator according to an embodiment of the disclosure.

First of all, notification may be provided through the refrigerator 100. To be specific, the processor 130 may control the display 140 to display a notification. For example, as illustrated in FIG. 8A, the processor 130 may display a text 810 like "mode change end soon" on the display 140.

Figure 8B:
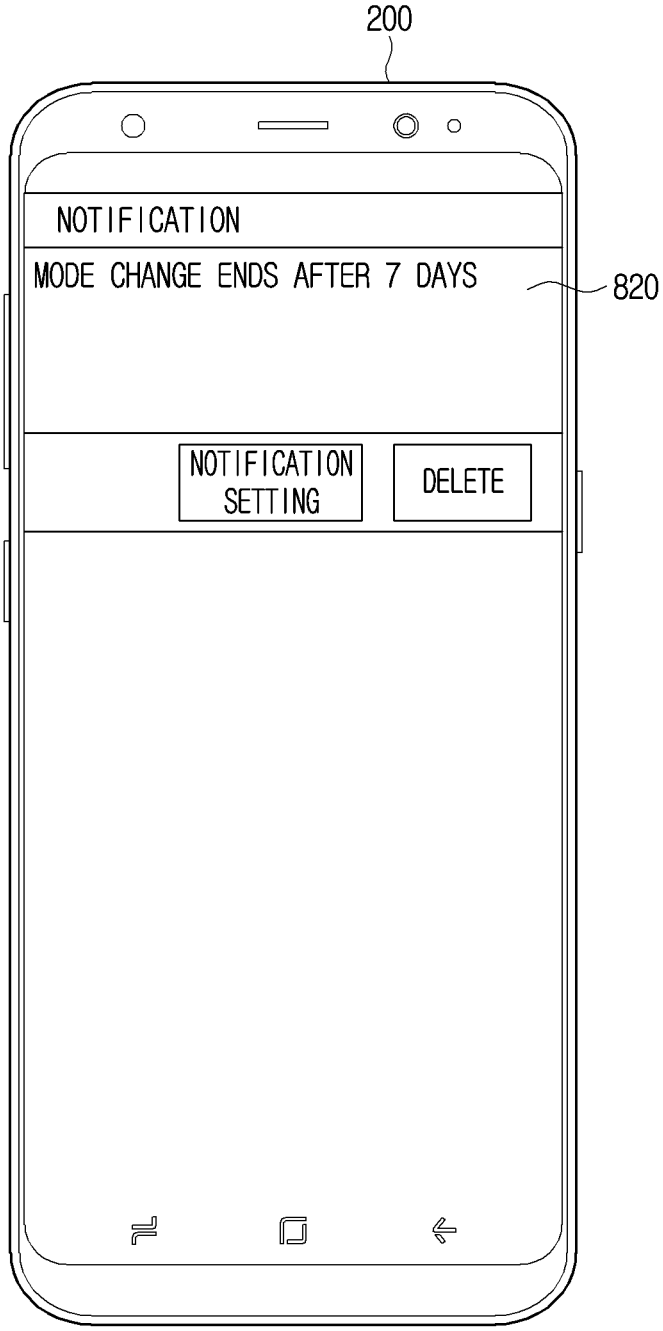

In addition, the notification may be provided through the electronic apparatus 200. To be specific, the processor 130 may transmit a notification to the server 300 for communicating with the electronic apparatus 200 through a communication interface so that the notification is displayed on the electronic apparatus 200. Accordingly, the server 300 may transmit the notification received from the refrigerator 100 to the electronic apparatus 200. In this case, as an example, as shown in FIG. 8B, the electronic apparatus 200 may display a text 820, such as "the mode change ends after 7 days".

In the meantime, although the above-described examples have been described as being provided at a predetermined time interval, this is merely an example, and when a specific event occurs in the refrigerator 100, the processor 130 may provide a notification. Here, the specific event may include an event, such as opening a door of the refrigerator 100, a user being sensed around the refrigerator 100, or the like.

Figure 8C:
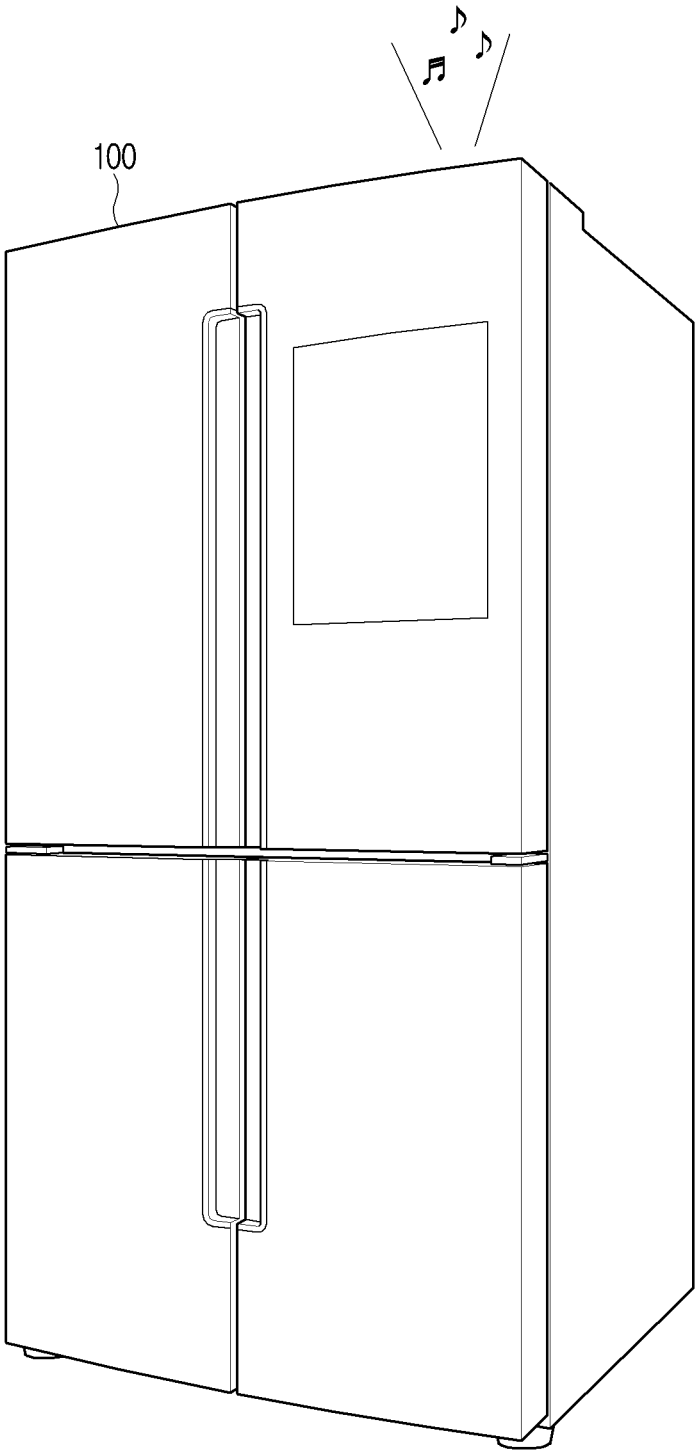

Further, in the above example, it has been described that the notification is provided in a format of a text, but this is merely exemplary. That is, for example, the processor 130 may, as illustrated in FIG. 8C, output a notification of an audio format through a speaker (not shown).

According to an embodiment of the disclosure, the user may be provided with a notification before the refrigerating compartment 21 is driven back to the refrigerating compartment, so that a user may take appropriate measures such as consuming food stored in the refrigerating compartment for freezing storage or moving the corresponding food back to the freezing compartment, or the like.

In the meantime, according to an embodiment of the disclosure, it is possible to change the set temperature of the refrigerating compartment 21 back to the refrigerating temperature according to a user command or to extend a predetermined time according to a user command even before a certain period of time has elapsed, and this will be described in more detail with reference to the accompanying drawings.

Figure 9:
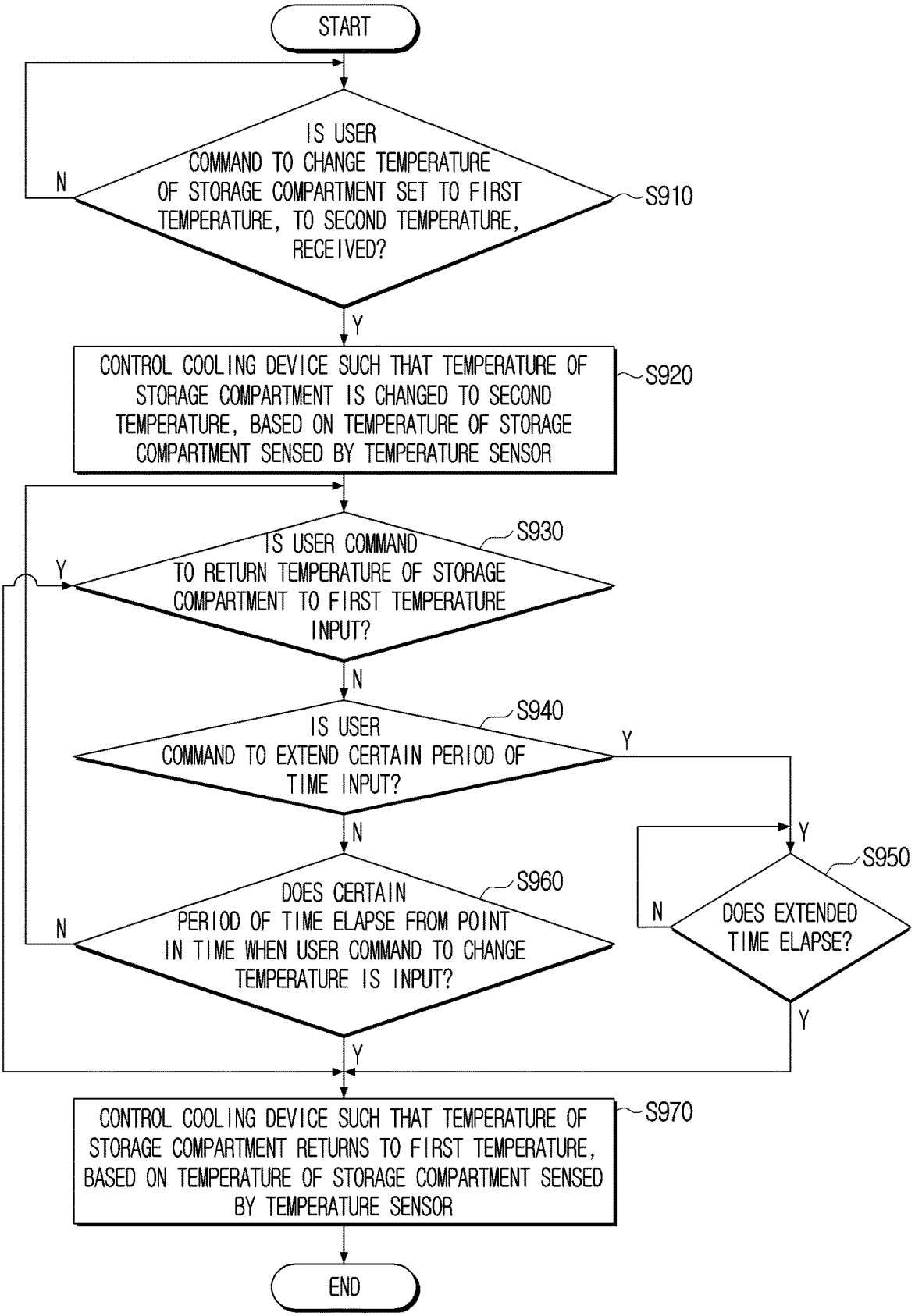
FIG. 9 is a flowchart illustrating a method of changing a set temperature of a refrigerator compartment according to a user command by a refrigerator according to an embodiment of the disclosure.

FIG. 9 is a flowchart illustrating a method of changing a set temperature of a refrigerator compartment according to a user command by a refrigerator according to an embodiment of the disclosure.

Since S910, S920, S960, S970 of FIG. 9 are the same as S510, S520, S530, S540 of FIG. 5, a duplicate description will be omitted.

The processor 130 may, based on a user command to return the temperature of the storage compartment to the first temperature being input before the certain period of time elapses in operation S930-Y, control the cooling device such that the temperature of the storage compartment returns to the first temperature based on the temperature of the storage compartment sensed by the temperature sensor 120 in operation S970.

That is, even before the certain period of time has elapsed from the point in time at which a user command to change the set temperature of the refrigerating compartment 21 to the freezing temperature, when a user command for changing the set temperature of the refrigerating compartment 21 to the refrigerating temperature is input, the processor 130 may control the refrigerating compartment 21 to be driven back to the refrigerating temperature.

In this case, a user command to return the temperature of the storage compartment to the first temperature may be input through various methods.

For example, when the display 140 is implemented as a touch screen, the user command may be input by a touch operation on the display 140. For this, the processor 130 may display, on the display 140, a menu button (not shown) for receiving a user command for returning the set temperature of the refrigerating compartment 21 to the refrigerating temperature. In this case, the processor 130 may display a menu button (not shown) on the display 140 or activate a menu button (not shown) on the display 140 only while the refrigerating compartment 21 is being driven at the freezing temperature. Accordingly, a user may touch a menu button (not shown) to input a user command for returning the set temperature of the refrigerating compartment 21 to the refrigerating temperature. However, this is an example, and the processor 130 may receive a user command for returning the temperature of the storage compartment to the first temperature through a physical button provided in the refrigerator 100 or a button provided on the touch panel.

As another example, the user command may be input through the electronic apparatus 200.

To be specific, when an application installed in the electronic apparatus 200 is executed, the electronic apparatus 200 may access the server 300 through a wireless network. The electronic apparatus 200 may display a menu button (not shown) for receiving a user command through an application execution screen. In this case, when a menu button (not shown) is selected, the electronic apparatus 200 may transmit a user command for returning the set temperature of the refrigerating compartment 21 to the refrigerating temperature through the server 300 to the refrigerator 100. Accordingly, the processor 130 may receive a user command from the electronic apparatus 200.

In the meantime, the processor 130 may, based on a user command to extend a certain period of time being input before the certain period of time elapses in operation S940-Y, if the extended time elapses in operation S950-Y, control the cooling device 110 such that the temperature of the storage compartment returns to the first temperature based on the temperature of the storage compartment sensed by the temperature sensor 120.

That is, the processor 130 may extend a certain period of time when a user command for extending the certain period of time is input before a predetermined time elapses from a point in time when a user command for changing the set temperature of the refrigerating compartment 21 to the freezing temperature elapses. Here, the extended period may be preset in the manufacturing stage. However, according to an embodiment, the extended period may be set according to a user command In addition, when the extended period has elapsed, the processor 130 may control so that the refrigerating compartment 21 is driven back to the refrigerating temperature.

In the meantime, a user command to extend the certain period of time may be input through various methods.

For example, when the display 140 is implemented as a touch screen, the user command may be input by a touch operation on the display 140. For this, the processor 130 may display a menu button (not shown) for receiving a user command for extending the certain period of time on the display 140. In this case, the processor 130 may display a menu button (not shown) on the display 140 or activate a menu button (not shown) on the display 140 only while the refrigerating compartment 21 is being driven at the freezing temperature. Accordingly, the user may input a user command to extend the certain period of time by touching a menu button (not shown). However, this is merely exemplary, and the processor 130 may receive a user command to extend the certain period of time through a button, or the like, provided in a touch panel or a physical button provided in the refrigerator 100.

As another example, a user command may be input through the electronic apparatus 200.

Figure 10A:
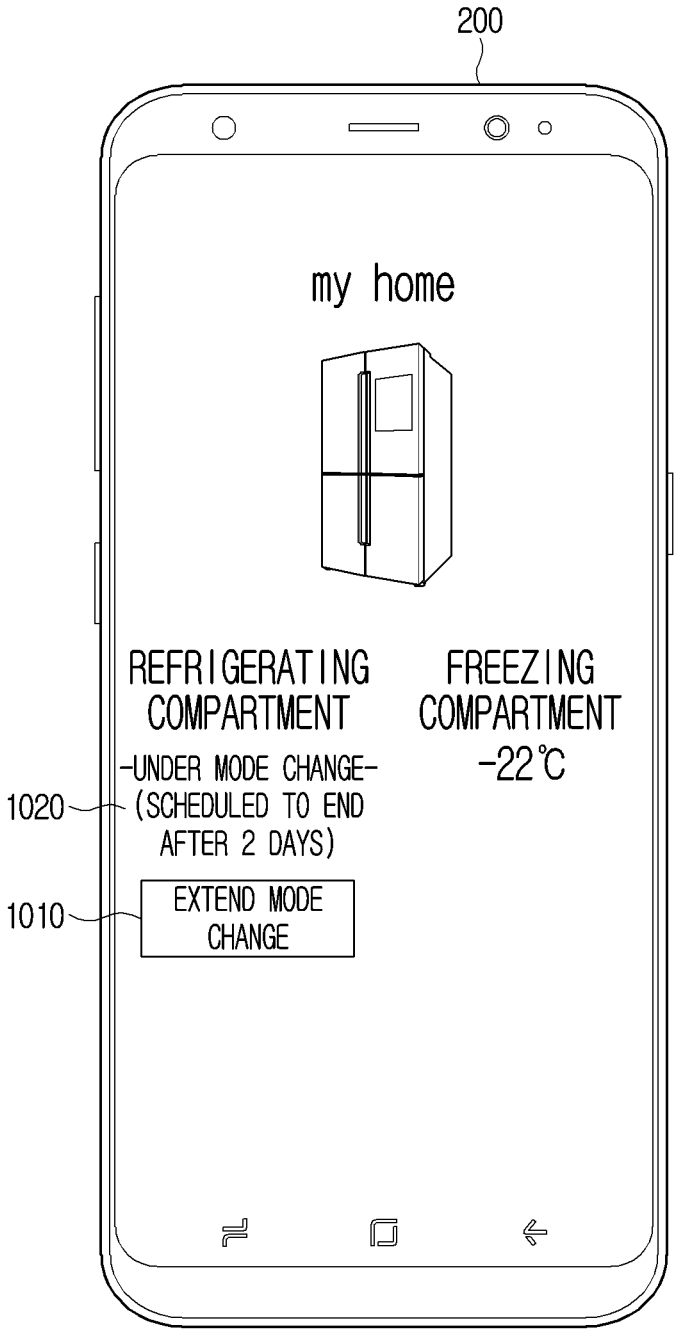
FIGS. 10A to 10C are diagrams illustrating that a refrigerator according to an embodiment of the disclosure receives a user command for extending a certain period of time.

To be specific, when an application installed in the electronic apparatus 200 is executed, the electronic apparatus 200 may access the server 300 through a wireless network. Referring to FIG. 10A, the electronic apparatus 200 may display a menu button 1010 for receiving a user command for extending the certain period of time through an application execution screen. In this case, according to an embodiment, the electronic apparatus 200 may display information 1020 about the remaining time until the set temperature of the refrigerating compartment 21 is automatically returned to the refrigerating temperature. For this, the processor 130 may transmit information about the remaining time to the server 300, and the electronic apparatus 200 may receive the corresponding information from the server 300.

Figure 10B:
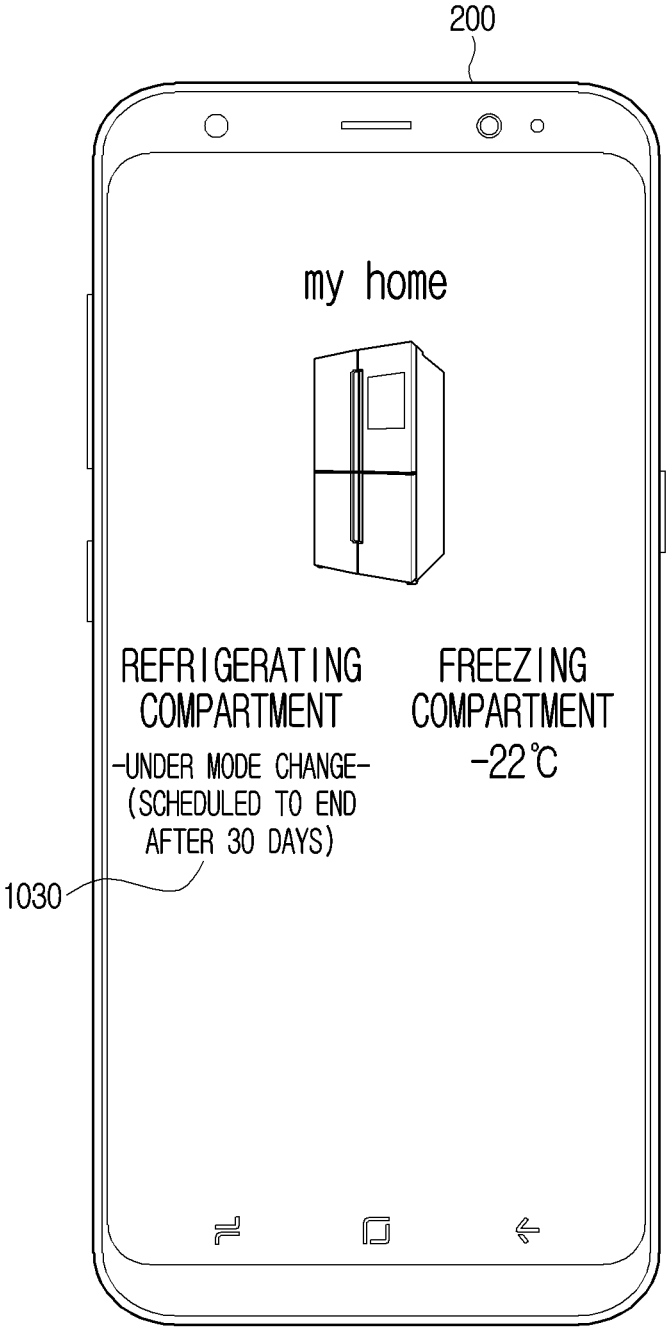

When the menu button 1010 is selected, the electronic apparatus 200 may transmit a user command for extending a predetermined time to the refrigerator 100 through the server 300. Accordingly, the processor 130 may receive a user command from the electronic apparatus 200. In this case, as shown in FIG. 10B, the electronic apparatus 200 may display information 1030 on the extended time. For this, the processor 130 may transmit information about the extended time to the server 300, and the electronic apparatus 200 may receive the information from the server 300.

Figure 10C:
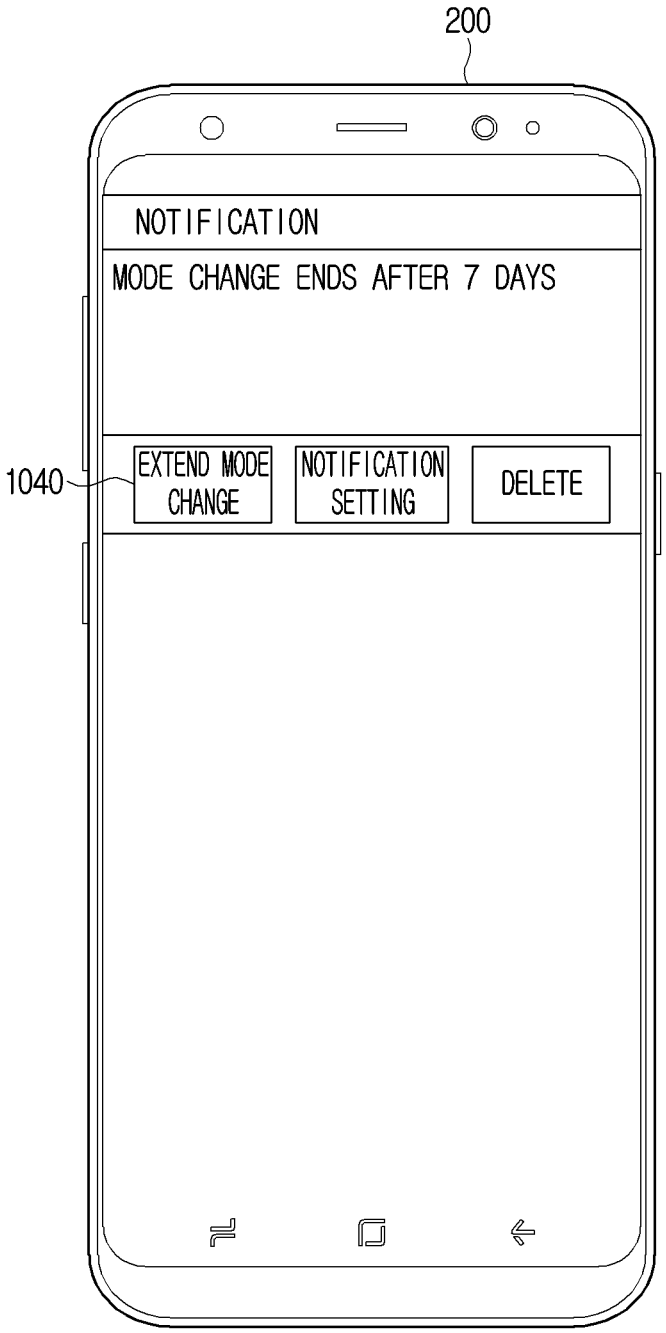

In the meantime, as described above, the processor 130 may, before the certain period of time elapses, provide a notification that indicates that the temperature of the storage compartment is to return to the first temperature. At this time, as illustrated in FIG. 10C, the electronic apparatus 200 may display a menu button 1040 for receiving a user command to extend the certain period of time.

As such, according to an embodiment of the disclosure, a user may determine the point in time at which the refrigerating compartment returns to the refrigerating temperature according to a user command and thus, the refrigerating compartment may be used more efficiently while consuming less power.

In the meantime, the processor 130 may identify a change in an object for storage stored in the refrigerating compartment 21, provide a notification to a user based on the identified change in the object for storage, or identify whether to extend the certain period of time.

To be specific, the processor 130 may, when it is identified that the object for storage stored in the refrigerating compartment 21 is reduced, provide a notification to request input of a user command to return the temperature of the storage compartment to the first temperature. In addition, the processor 130 may, when it is identified that the object for storage stored in the refrigerating compartment 21 is reduced, identify that the certain period of time will not be extended.

In contrast, the processor 130 may, when it is identified that the object for storage stored in the refrigerating compartment 21 is not reduced, may identify to extend the certain period of time and provide a notification that the certain period of time is extended.

For this, the processor 130 may identify a change in the object for storage stored in the refrigerating compartment 21. To be specific, the processor 130 may identify the change in the object for storage based on at least one of weight of the object for storage, the number of times of opening the door of the refrigerator 100, temperature inside the refrigerator 100, or an image capturing the inside the refrigerator 100, and this will be described in detail with reference to the attached drawings.

Figure 11:
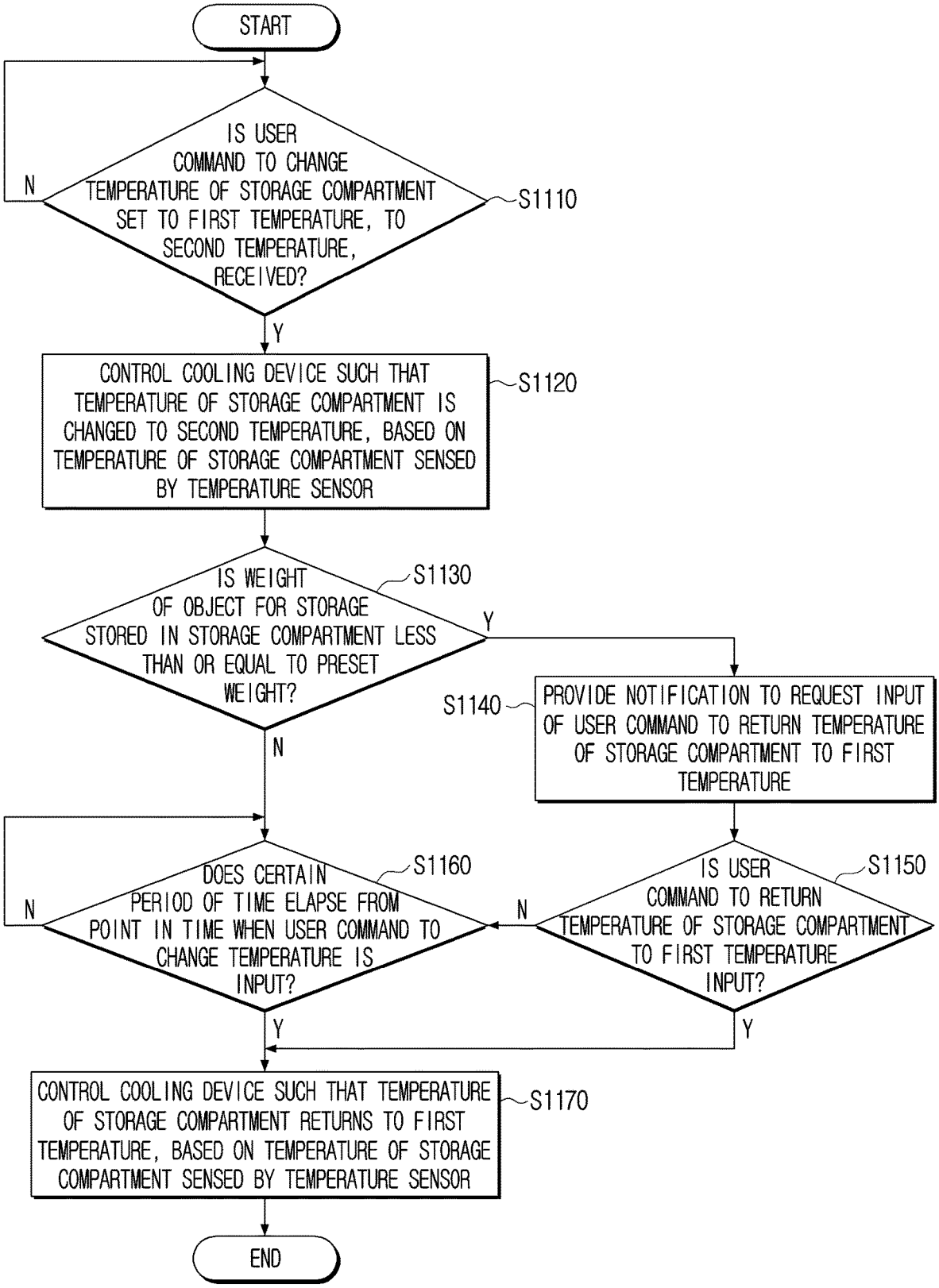
FIG. 11 is a flowchart illustrating a method by which a refrigerator provides a notification according to the weight of an object for storage according to an embodiment of the disclosure.

FIG. 11 is a flowchart illustrating a method by which a refrigerator identifies a change in the object for storage based on a weight of the object for storage and provides a notification according to the identified change in the object for storage according to an embodiment of the disclosure.

In that S1110, S1120, S1160, S1170 of FIG. 11 are the same as S510, S520, S530, S540 of FIG. 5, a duplicate description will be omitted.

After a user command to change the temperature of the storage compartment set to the first temperature, to the second temperature, the processor 130 may identify a weight within the storage compartment at a predetermined time interval. For this, the refrigerator 100 may include a weight sensor (not shown). In this case, a weight sensor (not shown) may be installed on a shelf of the refrigerator 100 to sense the weight of an object for storage placed on a shelf or the like. Accordingly, the processor 130 may determine the weight of the object for storage stored in the refrigerating compartment 21 by using a weight sensor (not shown).

In addition, the processor 130 may identify whether the identified weight of the object for storage is less than or equal to a preset weight in operation S1130. Accordingly, when the identified weight of the object for storage is less than or equal to a preset weight, the processor 130 may identify that the object for storage is reduced.

To be specific, the processor 130 may determine a shelf on which a storage having a weight greater than a predetermined weight is placed, by using the weight of the object for storage sensed by a weight sensor (not shown) after a user command for changing the temperature is input. In addition, the processor 130 may determine whether the weight of the object for storage sensed in the corresponding shelf is reduced by a weight sensor (not shown) to be less than or equal to a preset weight.

Accordingly, the processor 130 may identify a weight of an object for storage is reduced based on the identified weight of the object for storage being less than or equal to a preset weight in operation S1130-Y. In addition, the processor 130 may provide a notification to request input of a user command to return the temperature of the storage compartment to the first temperature in operation S1140.

Here, the notification may include content requesting input of a user command to return the temperature of the storage compartment to the first temperature. In this case, the notification may further include information indicating that the weight or quantity of object for storage of the storage compartment has been reduced.

In addition, the notification may be provided through various methods.

First, a notification may be provided through the refrigerator 100. To be specific, the processor 130 may control the display 140 to display a notification. For example, the processor 130 may display a text such as "Isn't food emptied in the refrigerating compartment? Please release a mode change function to save electric charges" on the display 140 to save electric charges.

Figure 12:
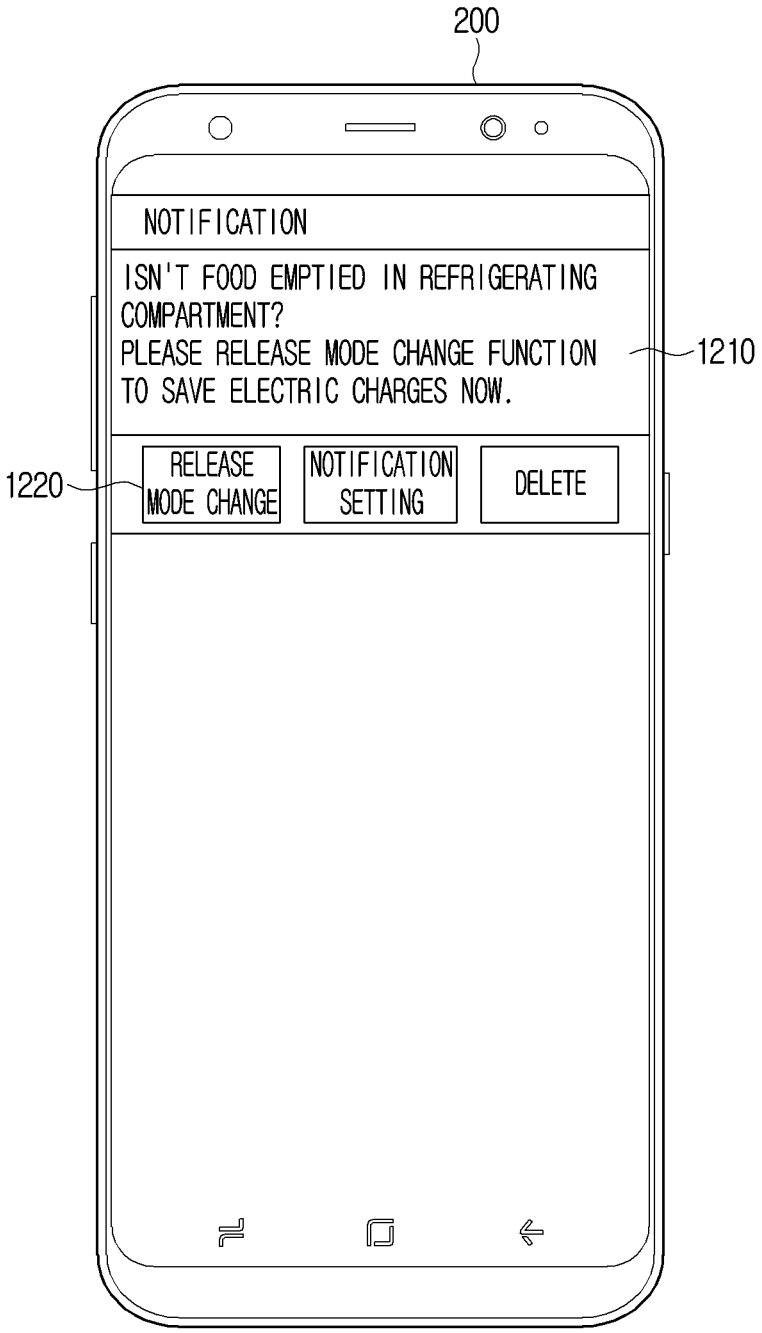
FIG. 12 is a view illustrating that a refrigerator receives a user command for returning a temperature of a storage compartment according to an embodiment of the disclosure.

In addition, the notification may be provided through the electronic apparatus 200. To be specific, the processor 130 may transmit a notification to the server 300 for communicating with the electronic apparatus 200 through a communication interface (not shown) such that the notification is displayed on the electronic apparatus 200. Accordingly, the server 300 may transmit the notification received from the refrigerator 100 to the electronic apparatus 200. As an example, as shown in FIG. 12, the electronic apparatus 200 may display a text 1210 like "Isn't food emptied in the refrigerating compartment? Please release a mode change to save electric charges". In this case, according to an embodiment, the electronic apparatus 200 may display a menu button 1220 for receiving a user command for returning the set temperature of the refrigerating compartment 21 to the refrigerating temperature.

When the menu button 1220 is selected, the electronic apparatus 200 may transmit a user command to return the set temperature of the refrigerating compartment 21 to the refrigerating temperature to the refrigerator 100 through the server 300. Accordingly, the processor 130 may receive a user command from the electronic apparatus 200.

As such, the processor 130 may, based on a user command to return the temperature of the storage compartment to the first temperature being input in operation S1150-Y, control the cooling device such that the temperature of the storage compartment returns to the first temperature in operation S1170. In the meantime, after a user command to return the temperature of the storage compartment to the first temperature is not input in operation S1150-N, if the certain period of time elapses in operation S1160-Y, the processor 130 may control the cooling device such that the temperature of the storage compartment returns to the first temperature in operation S1170.

In the meantime, when a weight less than or equal to a preset weight is sensed by a weight sensor (not shown) in the above-described example, it is described that the object for storage is reduced, but this is merely an example. That is, the processor 130 may identify that the object for storage is reduced even when the weight of the object for storage sensed by the weight sensor (not shown) is reduced, and provide a notification.

Also, in the above example, it has been described that the weight inside the storage compartment is identified at a predetermined time interval by using a weight sensor (not shown) by the processor 130, this is merely exemplary. That is, the processor 130 may, when a specific event occurs in the refrigerator 100, identify the weight inside the storage compartment. Here, the specific event may include an event such as opening and closing the door (e.g., doors 31, 33 of the refrigerating compartment 21) of the refrigerator 100, or the like.

As such, according to an embodiment of the disclosure, when the object for storage in the refrigerating compartment 21 is reduced, the processor 130 may receive a notification to recommend to end the function to drive the refrigerating compartment 21 to the freezing temperature, and accordingly, the refrigerating compartment may be used more efficiently while consuming less power.

In the meantime, according to an embodiment of the disclosure, the refrigerator 100 may identify whether to extend the certain period of time based on the change of the object for storage, which will be described in detail with reference to the accompanying drawings.

Figure 13:
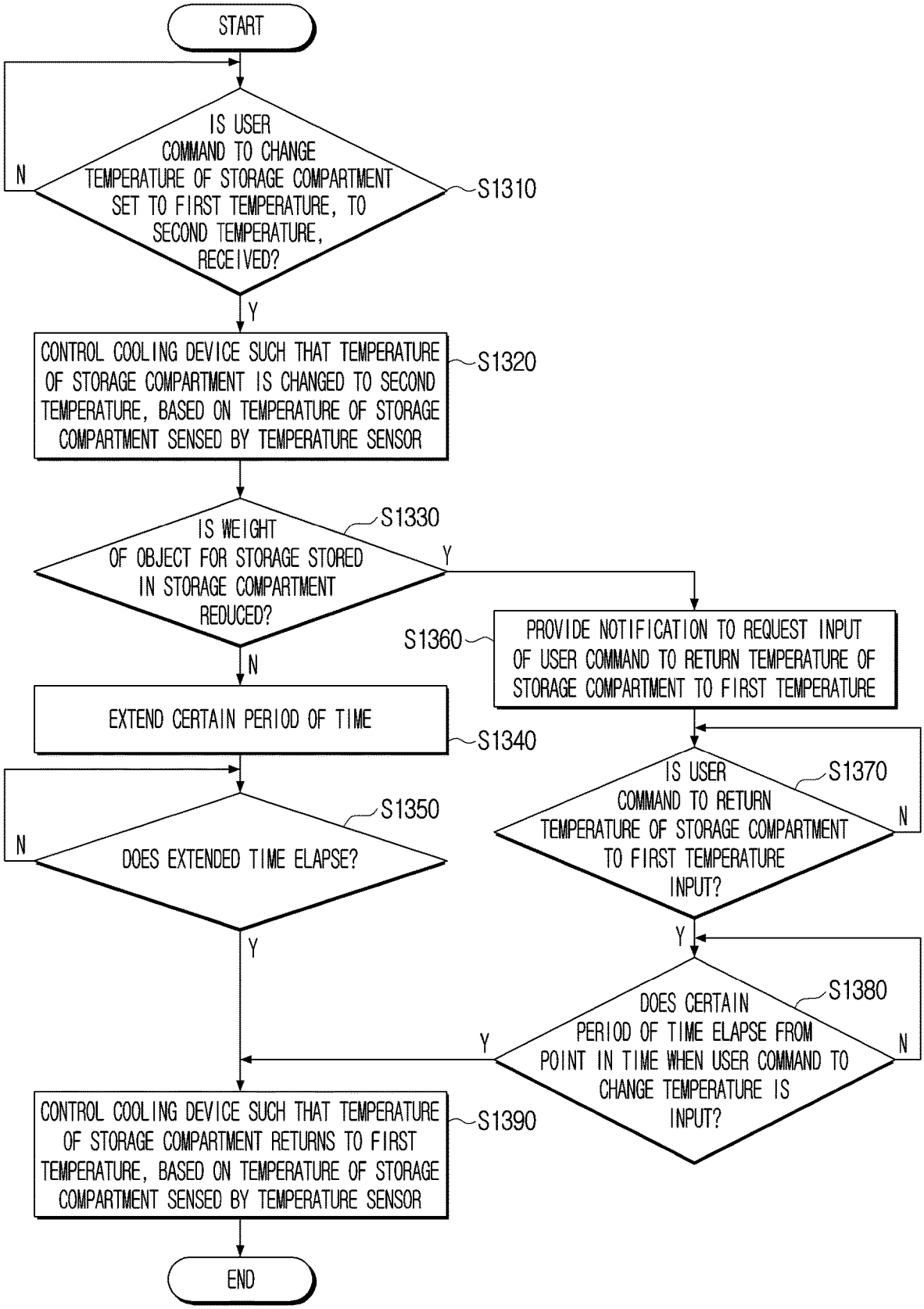
FIG. 13 is a diagram illustrating a method in which a refrigerator automatically extends a predetermined time according to the weight of an object for storage according to an embodiment of the disclosure.

FIG. 13 is a flowchart illustrating a method by which a refrigerator identifies a change in the object for storage based on a weight of the object for storage and identifies whether to extend the certain period of time according to the identified change in the object for storage according to an embodiment of the disclosure.

Since S1310, S1320, S1380, S1390 of FIG. 13 are the same as S510, S520, S530, S540 of FIG. 5, a duplicate description will be omitted.

The processor 130 may identify the weight of the object for storage in the storage compartment. For this, the refrigerator 100 may include a weight sensor (not shown). In this case, the weight sensor (not shown) may be installed in a shelf or the like of the refrigerator to sense weight of the object for storage placed on a shelf or the like. Accordingly, the processor 130 may determine the weight of the stored project in the refrigerating compartment 21 by using the weight sensor (not shown). In addition, based on the change in the weight of the object for storage, the processor 130 may identify change in the object for storage.

The processor 130 may identify whether to extend the certain period of time based on the identified change in the object for storage in the storage compartment.

To be specific, the processor 130 may determine whether the weight of the object for storage is reduced after a user command for changing temperature is input by using weight of the object for storage sensed by the weight sensor (not shown).

In this case, the processor 130 may determine the weight of the object for storage in the storage compartment at a predetermined time interval. In the meantime, according to an embodiment, the processor 130 may, if the door (e.g., doors 31, 33 of the refrigerating compartment 21) of the refrigerator 100 is opened and then closed, determine the weight of the object for storage in the storage compartment.

In addition, the processor 130 may, if it is determined that the weight of the object for storage is reduced, identify that the object for storage is reduced and identify that the certain period of time is not extended. In addition, when it is determined that the weight of the object for storage is reduced in operation S1330-Y, the processor 130 may identify that the object for storage is reduced, and may provide a notification to request input of the user command to return the temperature of the storage compartment to the first temperature in operation S1360. Meanwhile, in that operations S1370, S1380, S1390 after S1360 are the same as FIG. 11, a duplicate description will be omitted.

In the meantime, if it is determined that the weight of the object for storage is not increased or changed in operation S1330-N, the processor 130 may identify that the object for storage is not reduced and may extend the certain period of time in operation S1340. In the meantime, operations S1350 and S1390 after S1340 are the same as FIG. 9 and a duplicate description will be omitted.

When the certain period of time is extended, the processor 130 may provide a notification that the certain period of time is extended. Here, the notification that the certain period of time is extended may include information about a reason of extension or a period of extension.

Figure 14:
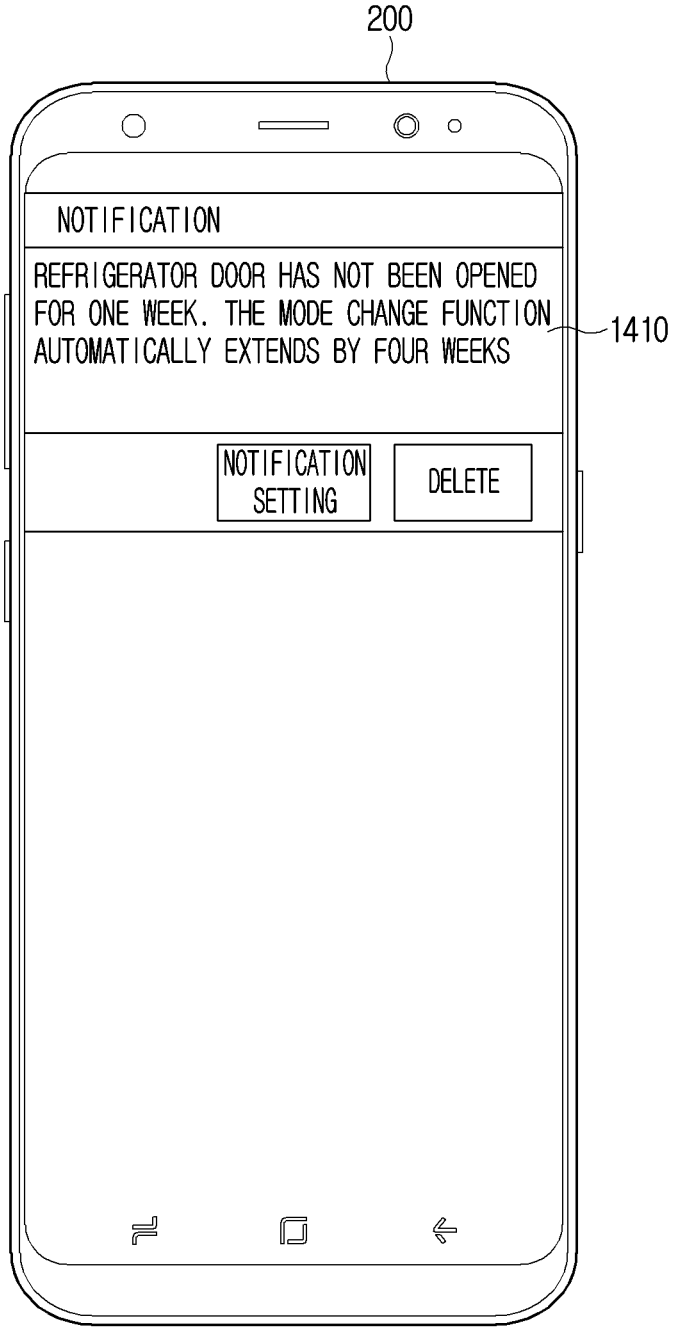
FIG. 14 is a diagram illustrating a method for providing a notification by a refrigerator according to an embodiment of the disclosure.

For example, as shown in FIG. 14, when the door provides a notification based on the number of times the door is opened, the processor 130 may display a text 1410 like "the refrigerator door has not been opened for one week. The mode change function automatically extends by four weeks" through the electronic apparatus 200. In this case, the processor 130 may display the text on the display 140. Meanwhile, contents related to providing a notification based on the number of times the door is opened will be described again below.

According to an embodiment of the disclosure, that the weight of the object for storage stored in the refrigerating compartment 21 is not reduced while the refrigerating compartment 21 is driven at the freezing temperature means that the object for storage to be stored at the freezing temperature is continuously stored in the refrigerating compartment or the object for storage is newly added to the refrigerating compartment, and it is considered that the user wishes to use the refrigerating compartment 21 as the freezing compartment for a longer time. In this case, the refrigerator 100 automatically extends a time for driving the refrigerating compartment 21 to a freezing temperature, thereby increasing user convenience.

In the meantime, in the above example, it has been described that the refrigerator 100 identifies a change in the object for storage based on the weight of the object for storage, provide a notification to recommend to end the function to drive the refrigerating compartment 21 to the freezing temperature, or automatically extend a function to drive the refrigerating compartment 21 to the freezing temperature, but this is merely an example. That is, the processor 130 may identify the change in the object for storage based on the number of times the door of the refrigerator 100 is opened, temperature inside the refrigerator 100, an image capturing the inside of the refrigerator 100, or the like, provide a notification based on the identified change of the object for storage, or automatically extend the certain period of time.

First, the processor 130 may identify a change in the object for storage based on the number of times the door (e.g., doors 31, 33 of the refrigerating compartment 21) of the refrigerator is opened, and provide a notification for recommending a function of driving the refrigerating compartment 21 to the freezing temperature according to a change in the identified object for storage, or automatically extend a function of driving the refrigerating compartment 21 to the freezing temperature.

For this, the processor 130 may sense the number of times a door is opened. To be specific, the refrigerator 100 may include a door sensor (not shown) for sensing that the doors (31 to 34) of the refrigerator are opened and closed. Accordingly, the processor 130 uses a door sensor (not shown) to sense the number of times the door of the refrigerator 100 is opened.

In addition, the processor 130 may identify a change in the object for storage based on the number of times the door is open, and may identify whether to provide a notification or extend the certain period of time based on the identified change in the object for storage.

In detail, the processor 130 may determine whether the number of times the door is opened is greater than a predetermined number of times after a user command for changing a temperature is input by using the number of times a door sensed by a door sensor (not shown) is opened. Here, the preset number of times may be preset in a manufacturing stage. However, according to an embodiment, the predetermined number of times may be set and changed according to a user command.

When it is determined that the number of times the door is opened is greater than a predetermined number of times, the processor 130 may identify that the object for storage is reduced and identify that the certain period of time does not extend. In this case, when it is determined that the number of times the door is opened is greater than a predetermined number of times, the processor 130 may identify that the object for storage is reduced, and provide a notification requesting input of a user command for returning the temperature of the storage compartment to the first temperature.

However, when it is identified that the number of times the door is opened is not greater than a predetermined number of times, the processor 130 may identify that the object for storage is not reduced and extend the certain period of time. When the certain period of time is extended, the processor 130 may provide a notification that the certain period of time has been extended.

That is, according to an embodiment of the disclosure, the refrigerating compartment 21 is used as a freezing compartment for the certain period of time instead of its unique function, and thus a user is more likely to store an object for storage that needs to be stored in the refrigerating compartment 21, such as food requiring storage for a short time before taking. Accordingly, since the number of open doors being large may mean that the user takes out object for storage a lot from the refrigerating compartment 21, and thus it is possible to identify that the object for storage is reduced. Therefore, according to an embodiment of the disclosure, the refrigerator 100 may identify a change in the object for storage based on the number of times the door is opened, and determine whether to extend the certain period of time.

In addition, the processor 130 may identify a change in the object for storage based on the time taken for the temperature of the refrigerating compartment 21 to reach the second temperature after opening and closing the door (e.g., the doors 31, 33 of the refrigerating compartment 21) of the refrigerator, and provide a notification for recommending the function of driving the refrigerating compartment 21 to the freezing temperature based on the identified change in the object for storage, or automatically extend the function of driving the refrigerating compartment 21 to the freezing temperature.

First of all, the processor 130 may identify the time taken for the temperature of the refrigerating compartment 21 to reach the second temperature after the door of the refrigerator 100 is open and then closed.

In addition, the processor 130 may identify a change in the object for storage based on the time taken when the temperature of the refrigerating compartment 21 reaches the second temperature after the door is opened and closed, and may provide a notification or identify whether to extend the certain period of time based on a change in the identified object for storage.

To be specific, the processor 130 may determine whether the time taken for the temperature of the refrigerating compartment 21 to the second temperature is greater than a preset time after the door is opened and then closed, after the user command to change temperature is input, based on the time taken for the temperature of the refrigerating compartment 21 to reach the second temperature after the door is opened and then closed. Here, the preset time may be preset in a manufacturing stage. However, according to an embodiment, the preset time may be set and changed according to a user command.

In addition, when it is determined that the time taken for the temperature of the refrigerating compartment 21 to reach the second temperature is less than a preset time after the door is opened and closed, the processor 130 may identify that the object for storage is reduced and the certain period of time is not extended. In this case, when it is identified that the time taken for the temperature of the refrigerating compartment 21 to reach the second temperature is greater than a preset time after the door is opened and closed, the processor 130 may identify that the object for storage is reduced and provide a notification requesting input of a user command for returning the temperature of the storage compartment to the first temperature.

However, when it is determined that the time taken for the temperature of the refrigerating compartment 21 to reach the second temperature is equal to or greater than a preset time after the door is opened and closed, the processor 130 may identify that the object for storage is not reduced and may extend the certain period of time. When the certain period of time is extended, the processor 130 may provide a notification that the certain period of time has been extended.

That is, according to an embodiment of the disclosure, when the door of the refrigerator 100 is opened, the cool air inside the refrigerating compartment 21 may be discharged to the outside, or the external hot air may be introduced into the refrigerating compartment 21 so that the temperature inside the refrigerating compartment 21 may be changed. When the door of the refrigerator 100 is closed, the temperature of the refrigerating compartment 21 reaches the second temperature by cool air supplied into the refrigerating compartment 21.

Here, the time taken for the temperature of the refrigerating compartment 21 to reach the second temperature after the door is opened and closed may vary according to the amount of object for storage in the refrigerating compartment 21. That is, as the amount of object for storage in the refrigerating compartment 21 increases, the time taken for the temperature of the refrigerating compartment 21 to reach the second temperature after opening and closing the door may increase, and as the amount of object for storage in the refrigerating compartment 21 decreases, the time taken for the temperature of the refrigerating compartment 21 to reach the second temperature opening and closing the door may decrease. Therefore, according to an embodiment of the disclosure, the change in the object for storage is identified based on the time taken for the temperature of the refrigerating compartment 21 to reach the second temperature after the door of the refrigerator is opened and closed, and whether to extend the certain period of time is determined.

In addition, the processor 130 may identify a change in the object for storage based on the volume of the object for storage in the refrigerating compartment 21, provide a notification of recommending the function of driving the refrigerating compartment 21 to the freezing temperature based on the identified change in the object for storage, or automatically extend the function of driving the refrigerating compartment 21 to the freezing temperature.

First, the processor 130 may identify a volume of an object for storage in the refrigerator 100. For this, the refrigerator 100 may include a camera (not shown). In this case, a camera (not shown) may be installed in the refrigerating compartment 21 and the freezing compartment 22, or the like, to capture an object for storage placed on a shelf of the refrigerator 100, or the like. Accordingly, the processor 130 may identify the volume of the object for storage stored in the refrigerating compartment 21 based on the image of the object for storage captured by the camera (not shown).

In addition, the processor 130 may identify a change in the object for storage based on the volume of the object for storage in the refrigerating compartment 21 and may identify whether to extend the certain period of time.

To be specific, the processor 130 may determine the volume of an object for storage stored in the refrigerating compartment 21 based on an image of the object for storage captured by a camera (not shown), and determine whether the volume of the object for storage is reduced after a user command for changing the temperature is input by using the volume of the object for storage stored in the refrigerating compartment 21.

In this case, the processor 130 may identify a volume of an object for storage in the refrigerating compartment 21 at a predetermined time interval. According to an embodiment, the processor 130 may determine the volume of the object for storage in the refrigerating compartment 21 even when the doors (e.g., the doors 31, 33 of the refrigerating compartment 21 are opened and closed) of the refrigerator 100.

And, when it is determined that the volume of the object for storage is reduced, the processor 130 may identify that the object for storage is reduced and identify that the certain period of time will not be extended. In this case, if it is determined that the volume of the object for storage is reduced, the processor 130 may identify that the object for storage is reduced, and provide a notification for requesting an input of a user command for returning the temperature of the refrigerating compartment 21 to the first temperature.

However, when it is identified that the volume of the object for storage is increased or not changed, the processor 130 may identify that the object for storage is not reduced and the certain period of time may be extended. When the certain period of time is extended, the processor 130 may provide a notification that the certain period of time has been extended.

That is, according to an embodiment of the disclosure, that the volume of the object for storage stored in the refrigerating compartment 21 is not reduced while the refrigerating compartment 21 is driven at the freezing temperature may mean that the object for storage that must be stored at the freezing temperature is continuously stored in the freezing compartment or the object for storage is newly added to the refrigerating compartment. On the contrary, that the volume of object for storage stored in the refrigerating compartment 21 has been reduced may be seen that the object for storage that must be stored at a freezing temperature are consumed a lot. Therefore, according to an embodiment of the disclosure, the refrigerator 100 may identify a change in the object for storage based on the volume of the object for storage, and determine whether to extend the certain period of time.

As described above, the processor 130 may identify a change in the object for storage based on the number of times the door is opened, the temperature in the refrigerator 100, an image of the inside of the refrigerator 100, and the like, and may extend a point in time when the set temperature of the refrigerating compartment 21 is changed back to the refrigerating temperature based on the identified change in the object for storage.

Meanwhile, in the above-described example, it is described that a change in object for storage is identified based on the weight of the object for storage, the number of times the door of the refrigerator 100 is opened, the temperature in the refrigerator 100, and the image of capturing the inside of the refrigerator 100, but this is merely an example, and the change in the object for storage may be identified based on the weight of the object for storage, the number of times the door of the refrigerator 100 is opened, the temperature in the refrigerator 100, and the combination of images of capturing the inside of the refrigerator 100.

To be specific, a user may open a door of the refrigerator 100 to check an object for storage or supplement an object for storage. In this case, although the object for storage is not actually reduced, the processor 130 may determine that the number of times the door is opened is greater than a predetermined number of times, and may identify that the object for storage is reduced.

Accordingly, the processor 130 may identify a change in the object for storage based on the number of times the door is opened and the weight of the object for storage. That is, even if it is determined that the number of times that the door is opened is greater than the predetermined number of times, when it is determined that the object for storage is not actually reduced and the weight of the object for storage is not reduced, the processor 130 may identify that the object for storage is not reduced.

Meanwhile, in the above-described example, the change of the object for storage is identified based on the number of times the door is opened and the weight of the object for storage, but this is only an example, and a change in the object for storage may be identified based on at least two of the weight of the object for storage, the number of times the door is opened, the temperature of the refrigerator 100, and the image of capturing the inside of the refrigerator 100.

As such, according to an embodiment of the disclosure, the refrigerator 100 may identify a change in the object for storage by considering various methods together and may more correctly identify a change in the object for storage.

Figure 15:
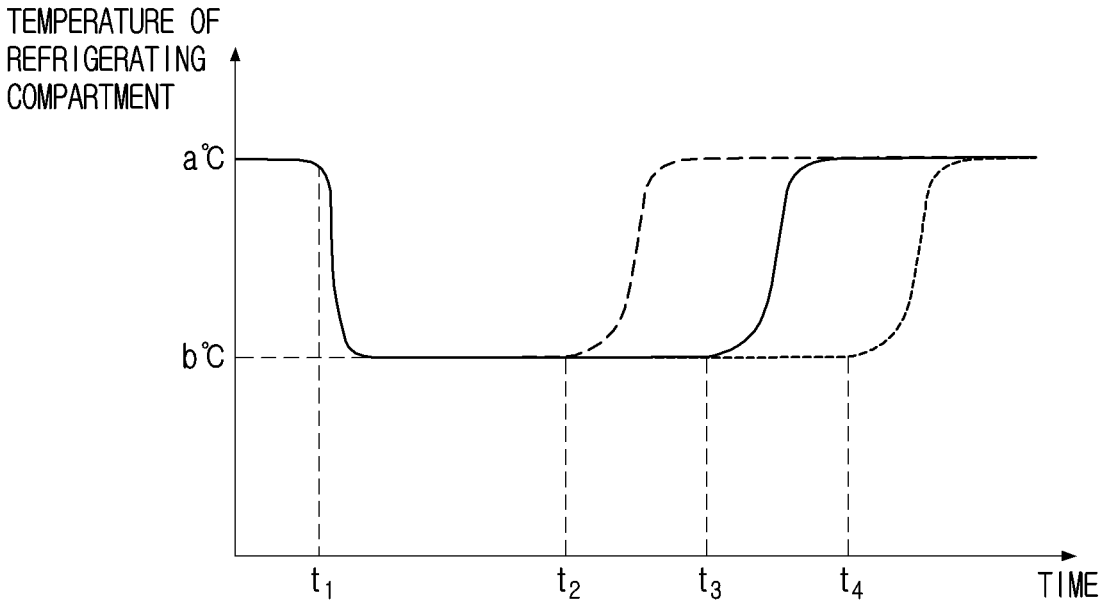
FIG. 15 is a graph illustrating a temperature of a refrigerating compartment controlled by a refrigerator according to an embodiment of the disclosure.

FIG. 15 is a graph illustrating a temperature of a refrigerating compartment controlled by a refrigerator according to an embodiment of the disclosure.

First, the processor 130 may control the cooling device 110 so that the temperature of the refrigerating compartment 21 is maintained to a° C. In this case, a° C. may be a refrigerating temperature (for example, a° C. may be 2° C.). Accordingly, the temperature of the refrigerating compartment 21 may be maintained to a° C.

In the meantime, if a user command for changing the set temperature of the refrigerating compartment 21 to the freezing temperature is input at $t_1$, the processor 130 may control the cooling device 110 to maintain b° C. after the temperature of the refrigerating compartment 21 is lowered to b° C. Here, b° C. may be a freezing temperature (for example, b° C. may be −12° C.). Accordingly, the temperature of the refrigerating compartment 21 is gradually lowered from a° C. to b° C., and then maintained at b° C.

The processor 130 may control the cooling device 110 such that the temperature of the refrigerating compartment 21 returns to a° C. at a time point (i.e., t 3) after the certain period of time has elapsed from a point in time when the user command is input. Accordingly, the temperature of the refrigerating compartment 21 is gradually increased from b° C. to a° C., and then maintained at a° C.

In the meantime, according to various embodiments as described above, the processor 130 may control the cooling device 110 so that the temperature of the refrigerating compartment 21 returns to a° C. at a point in time (that is, $t_2$) before $t_3$ or a point in time (that is, $t_4$) after $t_3$.

In addition, the processor 130 may provide various notifications before a point in time (e.g., $t_2$, $t_3$, $t_4$) of controlling the cooling device 110 to return the temperature of the refrigerating compartment 21 to a° C.

Here, the notification may include a notification that the temperature of the refrigerating compartment 21 will return to a° C., a notification to request input of a user command to return the temperature of the refrigerating compartment 21 to a° C., or the like.

Meanwhile, in the above-described embodiments, the storage compartment has been described as being refrigerating compartment 21, but this is merely an example. That is, when the refrigerating compartment 21 includes a plurality of storage boxes, the storage compartment may be at least one of the plurality of storage boxes.

In addition, the storage compartment may be a freezing compartment 22 (or when the freezing compartment 22 includes a plurality of storage boxes, the storage compartment may be at least one of a plurality of storage boxes). In this case, the processor 130 may change the set temperature of the freezing compartment 22 to a refrigerating temperature for the certain period of time. That is, the processor 130 may cool the object for storage of the freezing compartment 22 at a refrigerating temperature by changing the set temperature of the freezing compartment 22 to a refrigerating temperature for the certain period of time, and may cool the object for storage of the freezing compartment 22 to the freezing temperature by changing the set temperature of the freezing compartment 22 again to the freezing temperature when the certain period of time elapses. Accordingly, the first temperature is a freezing temperature, the second temperature is a refrigerating temperature, and the processor 130 controls the second cooling device 110-2 to drive the freezing compartment 22 at a refrigerating temperature for the certain period of time, and when a predetermined time has elapsed, the freezing compartment 22 may be driven again to the freezing temperature. Here, that the freezing compartment 22 is driven at a refrigerating temperature means that the cool air is supplied to the freezing compartment 22 through the second cooling device 110-2 so that the object for storage of the freezing compartment 22 may be stored or cooled at the temperature above zero, and that the freezing compartment 22 is driven at the freezing temperature may mean supplying the cool air to the freezing compartment 22 through the second cooling device 110-2 so that the object for storage of the freezing compartment 22 may be stored or cooled at a temperature below zero.

Figure 16:
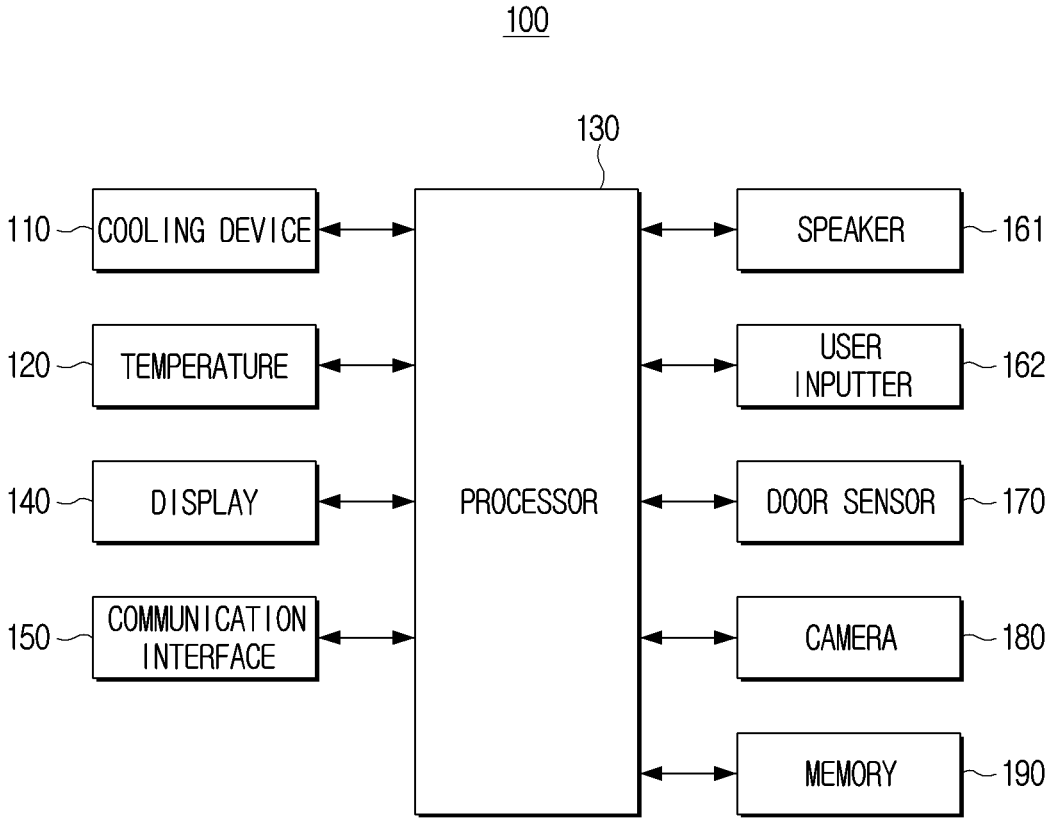
FIG. 16 is a block diagram illustrating a detailed configuration of an electronic apparatus according to an embodiment of the disclosure.

FIG. 16 is a block diagram illustrating a detailed configuration of an electronic apparatus according to an embodiment of the disclosure.

Referring to FIG. 16, the refrigerator 100 may include the cooling device 110, the temperature sensor 120, the processor 130, the display 140, a communication interface 150, a speaker 161, a user inputter 162, a door sensor 170, a camera 180, and a memory 190. Here, these components may be controlled by the processor 130. Meanwhile, the components illustrated in FIG. 16 are merely examples, and at least some of the components may be omitted or other components may be added according to an embodiment.

In addition, in that the cooling device 110, the temperature sensor 120, and the processor 130 have been described in FIGS. 1 to 5, a duplicate description will be omitted.

The display 140 may display various screens. For example, the display 140 may display various information related to functions and settings of the refrigerator 100, or may display various notifications. In addition, the processor 130 may display a menu button for receiving a user command on the display 140.

For this, the display 140 may be implemented as various types of displays such as LCD, LED, OLED, or the like. Meanwhile, the display 140 may be implemented as a touch screen. In this case, the processor 130 may receive various user commands by a touch operation on the touch screen.

The communication interface 150 may communicate with an external device. For example, the communication interface 150 may communicate with the electronic apparatus 200, the server 300, and the access point 400.

In this case, the processor 130 may transmit and receive various data to and from the server 300 which communicates with the electronic apparatus 200 through the communication interface 150. For example, the processor 130 may transmit a notification to the electronic apparatus 200 through the server 300 by using the communication interface 150. In addition, the processor 130 may receive, from the server 300, various user commands for controlling the refrigerator 100 input to the electronic apparatus 200 through the communication interface 150.

For this, the communication interface 150 may include a Wi-Fi communication module and may communicate with an external device by using a Wi-Fi communication method.

The speaker 161 may output various sounds. For example, the processor 130 may output a notification in a type of an audio through the speaker 161.

The user inputter 162 is configured to receive various user commands. For example, the user inputter 162 may include a touch panel, a physical button, and the like, and the user inputter 162 may include a voice recognition unit for recognizing a voice command of a user for controlling the refrigerator 100. Accordingly, the processor 130 may perform the above-described various operations according to a user command input through the user inputter 162.

The door sensor 170 is configured to sense opening and closing of a door. For example, the door sensor 170 may sense opening and closing of doors 31, 32, 33, 34 of the refrigerator 100.

Accordingly, the processor 130 may determine the opening, closing, the number of opening of the door, the number of closing of the door, or the like.

The camera 180 is configured to perform capturing. For this, the camera 180 may include an image sensor to receive external light, and may obtain an image captured by using an image sensor.

For example, the camera 180 may be installed in the refrigerating compartment 21 and/or the freezing compartment 22 to capture an object for storage in the refrigerating compartment 21 and/or the freezing compartment 22. In addition, the processor 130 may identify the volume of the object for storage stored in the refrigerating compartment 21 based on the image of the object for storage captured by the camera 180.

In addition, the camera 180 may capture the vicinity of the refrigerator 100. In this case, the processor 130 may identify whether the user is approaching the refrigerator 100 based on the image captured by the camera 180.

The memory 190 may store various instructions, programs, or data related to the operation of the refrigerator 100. For example, the memory 190 may store information about a first temperature, a second temperature, a time when the storage compartment is driven at a second temperature, a time when the storage compartment is driven at a second temperature, and the like.

The various example embodiments as described above may be implemented with software including instructions stored in the machine-readable storage media readable by a machine (e.g., a computer). A machine is a device which may call instructions from the storage medium and operate according to the called instructions, and may include an electronic apparatus of the embodiments. When the instructions are executed by a processor, the processor may perform a function corresponding to the instructions directly or by using other components under the control of the processor. The instructions may include a code generated by a compiler or a code executable by an interpreter. A machine-readable storage medium may be provided in the form of a non-transitory storage medium. Herein, the term "non-transitory" only denotes that a storage medium does not include a signal (e.g., electromagnetic wave) but is tangible, and does not distinguish the case in which a data is semi-permanently stored in a storage medium from the case in which a data is temporarily stored in a storage medium. For example, "non-transitory storage medium" may refer to a buffer temporarily storing data.

According to some embodiments, a method disclosed herein may be provided in a computer program product. A computer program product may be traded between a seller and a purchaser as a commodity. A computer program product may be distributed in the form of a machine-readable storage medium (e.g., a CD-ROM) or distributed online through an application store (e.g., PlayStore™, AppStore™). In the case of on-line distribution, at least a portion of the computer program product may be stored temporarily or at least temporarily in a storage medium, such as a manufacturer's server, a server in an application store, a memory in a relay server, and the like.

While the disclosure has been shown and described with reference to various example embodiments thereof, it will be understood by those skilled in the art that various changes in form and details may be made therein without departing from the spirit and scope of the disclosure as defined by the appended claims and their equivalents.

The invention claimed is:

1. A refrigerator comprising:

a refrigerating compartment;

a freezing compartment;

a temperature sensor configured to sense a temperature of the refrigerating compartment;

a cooling device; and a processor configured to:

control the cooling device such that a temperature of the refrigerating compartment is maintained at a first temperature which is a refrigerating temperature, and a temperature of the freezing compartment is maintained at a second temperature which is a freezing temperature, based on a user command to change the temperature of the refrigerating compartment being maintained at the first temperature, to the second temperature, being input, control the cooling device such that the temperature of the refrigerating compartment is changed to the second temperature based on the temperature of the refrigerating compartment sensed by the temperature sensor, and based on a certain period of time elapsing after a point in time when the user command is input, control the cooling device such that the temperature of the refrigerating compartment returns to the first temperature based on the temperature of the refrigerating compartment sensed by the temperature sensor.

2. The refrigerator of claim 1, wherein the processor is configured to, before the certain period of time elapses, provide a notification that indicates that the temperature of the refrigerating compartment is to return to the first temperature at a predetermined time interval.

3. The refrigerator of claim 2, further comprising:

a display, wherein the processor is configured to control the display to display the notification.

4. The refrigerator of claim 2, further comprising:

a communication interface, wherein the processor is configured to transmit, through the communication interface, the notification to a server that communicates with an electronic apparatus such that the notification is displayed on the electronic apparatus.

5. The refrigerator of claim 1, wherein the processor is configured to:

identify a weight of an object for storage in the refrigerating compartment at a predetermined time interval after the user command is input, and based on the identified weight of the object for storage being less than or equal to a preset weight, provide a notification to request input of a user command to return the temperature of the refrigerating compartment to the first temperature.

6. The refrigerator of claim 5, further comprising:

a communication interface, wherein the processor is configured to transmit, through the communication interface, the notification to a server that communicates with an electronic apparatus such that the notification is displayed on the electronic apparatus.

7. The refrigerator of claim 1, wherein the processor is configured to:

based on a user command to return the temperature of the refrigerating compartment to the first temperature being input before the certain period of time elapses, control the cooling device such that the temperature of the refrigerating compartment returns to the first temperature based on the temperature of the refrigerating compartment sensed by the temperature sensor.

8. The refrigerator of claim 1, wherein the processor is configured to:

based on a user command to extend the certain period of time being input before the certain period of time elapses and the extended certain period of time elapsing, control the cooling device such that the temperature of the refrigerating compartment returns to the first temperature based on the temperature of the refrigerating compartment sensed by the temperature sensor.

9. The refrigerator of claim 1, wherein the processor is configured to:

identify to extend the certain period of time based on a weight of an object for storage in the refrigerating compartment, and based on the extended certain period of time elapsing, control the cooling device such that internal temperature of the refrigerating compartment returns to the first temperature based on the internal temperature of the refrigerating compartment sensed by the temperature sensor.

10. The refrigerator of claim 9, wherein the processor is configured to, based on identifying that the weight of the object for storage in the refrigerating compartment increases or is not changed, identify that the certain period of time is to be extended.

11. A method of controlling a refrigerator that includes a refrigerating compartment, a freezing compartment, a temperature sensor configured to sense a temperature of the refrigerating compartment, and a cooling device, the method comprising:

controlling the cooling device such that a temperature of the refrigerating compartment is maintained at a first temperature which is a refrigerating temperature, and a temperature of the freezing compartment is maintained at a second temperature which is a freezing temperature, based on a user command to change the temperature of the refrigerating compartment being maintained at the first temperature, to the second temperature, being input, changing the temperature of the refrigerating compartment to the second temperature based on the temperature of the refrigerating compartment sensed by the temperature sensor;

based on a certain period of time elapsing after a point in time when the user command is input, returning the temperature of the refrigerating compartment to the first temperature based on the temperature of the refrigerating compartment sensed by the temperature sensor.

12. The method of claim 11, further comprising:

before the certain period of time elapses, providing a notification that indicates that the temperature of the refrigerating compartment is to return to the first temperature at a predetermined time interval.

13. The method of claim 12, wherein the providing comprises controlling a display of the refrigerator to display the notification.

14. The method of claim 12, wherein the providing comprises transmitting, through a communication interface of the refrigerator, the notification to a server that communicates with an electronic apparatus so that the notification is displayed on the electronic apparatus.

15. The method of claim 11, further comprising:

identifying a weight of an object for storage in the refrigerating compartment at a predetermined time interval after the user command is input; and based on the identified weight of the object for storage being less than or equal to a preset weight, providing a notification to request input of a user command to return the temperature of the refrigerating compartment to the first temperature.

16. A refrigerator comprising:

a storage compartment;

a temperature sensor;

a cooling device; and a processor configured to:

based on a user command to change a temperature of the storage compartment set to a first temperature, to a second temperature, being input, control the cooling device such that the temperature of the storage compartment is changed to the second temperature based on the temperature of the storage compartment sensed by the temperature sensor, based on a certain period of time elapsing after a point in time when the user command is input, control the cooling device such that the temperature of the storage compartment returns to the first temperature based on the temperature of the storage compartment sensed by the temperature sensor, and identify a weight of an object for storage in the storage compartment at a predetermined time interval after the user command is input, and based on the identified weight of the object for storage being less than or equal to a preset weight, provide a notification to request input of a user command to return the temperature of the storage compartment to the first temperature.

17. The refrigerator of claim 16, further comprising:

a communication interface, wherein the processor is configured to transmit, through the communication interface, the notification to a server that communicates with an electronic apparatus so that the notification is displayed on the electronic apparatus.

* * * * *